US008207465B2

(12) United States Patent
Maruyama et al.

(10) Patent No.: US 8,207,465 B2
(45) Date of Patent: Jun. 26, 2012

(54) KEY SWITCH UNIT

(75) Inventors: Junichi Maruyama, Shinagawa (JP); Tamotsu Koike, Shinagawa (JP); Takeshi Nishino, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 241 days.

(21) Appl. No.: 12/781,140

(22) Filed: May 17, 2010

(65) Prior Publication Data

US 2010/0294638 A1 Nov. 25, 2010

(30) Foreign Application Priority Data

May 20, 2009 (JP) ..... 2009-122535

(51) Int. Cl.
*H01H 13/70* (2006.01)

(52) U.S. Cl. ..... 200/344

(58) Field of Classification Search ..... 200/344, 200/5 A, 341, 345, 512, 517; 400/572, 491, 400/491.2, 495, 495.1, 496
See application file for complete search history.

(56) References Cited

U.S. PATENT DOCUMENTS

| | | | | |
|---|---|---|---|---|
| 4,453,063 | A * | 6/1984 | Wanatowicz et al. | 200/344 |
| 5,823,325 | A * | 10/1998 | Lin | 200/344 |
| 6,056,459 | A * | 5/2000 | Tsai | 400/496 |
| 6,399,909 | B1 | 6/2002 | Okada | |
| 6,632,039 | B2 * | 10/2003 | Lin | 400/490 |
| 2010/0025213 | A1 * | 2/2010 | Li | 200/344 |

FOREIGN PATENT DOCUMENTS

| | | |
|---|---|---|
| JP | 2001-167667 | 6/2001 |
| JP | 2008-251461 | 10/2008 |

* cited by examiner

*Primary Examiner* — Vanessa Girardi
(74) *Attorney, Agent, or Firm* — IPUSA, PLLC

(57) ABSTRACT

A key switch unit includes a keycap elongated in a lengthwise direction; a switch mechanism; a supporting plate supporting the switch mechanism; and a key reinforcement mechanism engaging the keycap on its lower side for reinforcement. The key reinforcement mechanism includes a first wire member having a beam part extending over substantially an overall dimension of the keycap in the lengthwise direction; a second wire member having a beam part extending in the lengthwise direction between a region contacting the switch mechanism and a first lengthwise end of the keycap; and a third wire member having a beam part extending in the lengthwise direction between the region and a second lengthwise end of the keycap. The beam parts engage the keycap on its lower side. The first, second, and third wire members have respective end parts turnably supported on the supporting plate.

5 Claims, 23 Drawing Sheets

KEY SWITCH UNIT

CROSS-REFERENCE TO RELATED APPLICATION

The present application is based upon and claims the benefit of priority of Japanese Patent Application No. 2009-122535, filed on May 20, 2009, the entire contents of which are incorporated herein by reference.

BACKGROUND OF THE INVENTION

1. Field of the Invention

The present invention relates generally to key switch units. The present invention relates more particularly to a key switch unit compatible with smaller, thinner keycaps.

2. Description of the Related Art

In notebook personal computers, keycaps provided in keyboards are becoming increasingly small and thin as the computers are reduced in size and thickness. The keycaps of keyboards, which are resin molded products, vary in vertical or horizontal size or shape depending on their types. For example, keycaps used for a Spacebar, a Shift key, an Enter key, etc., have a horizontally elongated shape larger in horizontal (right-left) dimension than other keycaps such as those of alphanumeric keys.

Such keycaps horizontally elongated in shape are low in strength where the thickness is reduced because of thinning. Therefore, for example, when a lengthwise end portion of the keycap is pressed, the keycap tilts or is bent to pivot circumferentially on a rubber actuator for pressing a switch part, which actuator is in contact with the center of the lower surface of the keycap.

As a reinforcement mechanism for compensating for such insufficiency of strength of the keycap, for example, Japanese Laid-Open Patent Application No. 2001-167657 proposes engaging a wire member with the lower surface of a keycap, where the wire member is formed by bending a metal wire of a stainless steel linear material of 1 mm in diameter so that the metal wire is sized to the shape of the keycap.

The wire member, which has an angular C-letter shape in plan view, includes a beam part extending in a lengthwise direction of the keycap and a pair of arm parts extending from both ends of the beam part at right angles with the beam part. The arm parts have their respective ends bent inward to form end parts of the wire member. The wire member is attached so that the end parts engage the holes or recesses of engagement parts projecting on the base of a membrane switch and the beam part engages the lower surface of the keycap. By thus causing the wire member to engage the lower surface of the keycap, the strength of the keycap is increased. As a result, the keycap moves downward in a horizontal position whichever part of its upper surface is pressed.

In the case of reinforcing a keycap on its lower surface side with a single wire member bent into an angular C-letter shape as described above, only one of the longer sides of the keycap, the one that engages the beam part of the wire member, is reinforced. Further, in the case where the keycap is molded to be thin to reduce its vertical dimension, the keycap itself is significantly reduced in rigidity. Accordingly, a pair of wire members is symmetrically placed to reinforce both of the longer sides of the keycap.

Reference may also be made to Japanese Laid-Open Patent Application No. 2008-251461 for related art.

SUMMARY OF THE INVENTION

According to an aspect of the present invention, a key switch unit includes a keycap elongated in a lengthwise direction; a switch mechanism configured to operate in response to receiving a pressing force through the keycap; a supporting plate configured to support the switch mechanism; and a key reinforcement mechanism engaging the keycap on a lower side thereof to reinforce the keycap, the key reinforcement mechanism including a first wire member having a first beam part extending over substantially an overall dimension of the keycap in the lengthwise direction and engaging the keycap on the lower side thereof; a second wire member having a second beam part extending in the lengthwise direction between a region contacting the switch mechanism and a first lengthwise end of the keycap and engaging the keycap on the lower side thereof; and a third wire member having a third beam part extending in the lengthwise direction between the region contacting the switch mechanism and a second lengthwise end of the keycap and engaging the keycap on the lower side thereof, wherein the first, second, and third wire members have respective end parts turnably supported on the supporting plate.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

However, in the above-described case of reinforcing the lower surface side of the keycap by symmetrically placing a pair of wire members, the beam part of each wire member is so placed as to avoid a switch part and a rubber actuator placed opposite the center part of the keycap. Therefore, the beam part of each wire member is provided outside the switch part and the rubber actuator, which makes it difficult to reduce the width (shorter-side dimension) of the keycap.

Further, in the case of reducing the number of wire members to one with the keycap being thin, it is possible to reduce the width of the keycap by the diameter of the wire member. However, reduction in the strength of the keycap itself prevents the entire keycap from moving in a horizontal position when the keycap is pressed, thus causing the problem of a poor operational feeling of the keycap.

Further, it may be possible to increase the strength of the keycap by using a material including filler for the keycap. However, this has the adverse effect that the engagement parts that engage a wire member become fragile, and thus this has not come to be applied to mass-production items.

According to one aspect of the present invention, a key switch unit is provided that may solve or reduce one or more of the above-described problems.

A description is given below, with reference to the accompanying drawings, of embodiments of the present invention.

[a] First Embodiment

In a first embodiment of the present invention, a description is given of a configuration of a key switch unit that includes a horizontally (laterally) elongated key in a keyboard having multiple keys.

Figure 1:
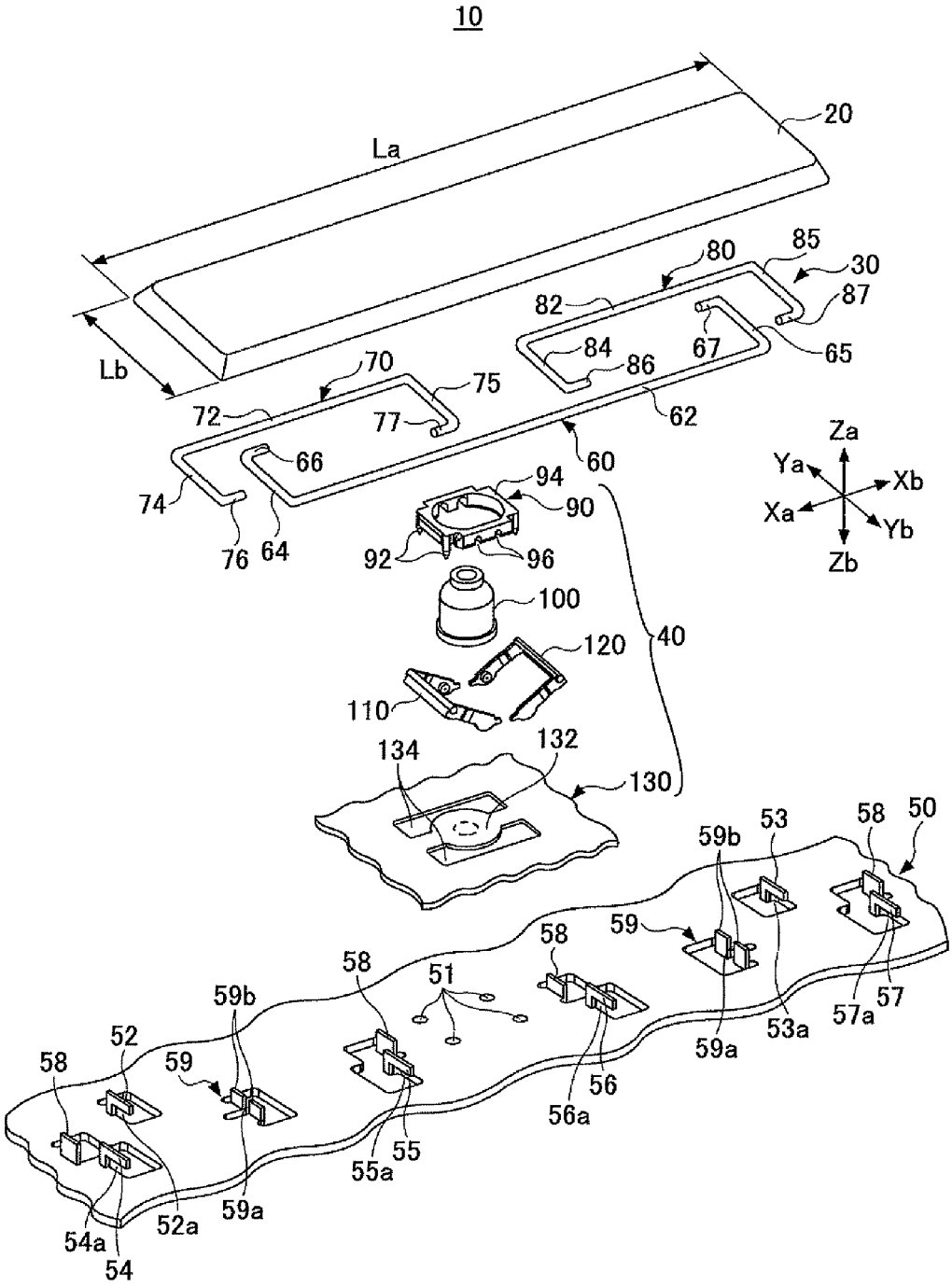
FIG. 1 is an exploded perspective view of part of a key switch unit according to a first embodiment of the present invention.

FIG. 1 is an exploded perspective view of part of a key switch unit 10 according to the first embodiment of the present invention.

As illustrated in FIG. 1, the key switch unit 10 includes a keycap 20 having an elongated shape, a key reinforcement mechanism 30, a switch mechanism 40, and a supporting plate 50.

The keycap 20 is used for, for example, a Spacebar, a Shift key, or an Enter key. The keycap 20 has a horizontally (laterally) elongated shape having a length La, or a longer-side (horizontal) dimension (in the Xa-Xb direction), n times a width Lb, or a shorter-side dimension (in the Ya-Yb direction) (that is, $La=n \cdot Lb$, where n is a value larger than one). Further, the keycap 20 is a thin resin molded product, and the thickness (vertical dimension) of the keycap 20 is such that the keycap 20 is relatively flexible. For example, the top part of the keycap 20 may be less than or equal to 1 mm in thickness.

The key reinforcement mechanism 30 has a first wire member 60, a second wire member 70, and a third wire member 80, which are so disposed as to reinforce the entire keycap 20 having a horizontally elongated shape. The first through third wire members 60, 70, and 80 are so arranged as to reinforce the entire lower side of the keycap 20 without crossing one another. Each of the first through third wire members 60, 70, and 80 is formed by bending a corrosion-resistant metal wire such as a stainless steel linear material into an angular C-letter shape.

The first wire member 60 includes a first beam part 62 that extends over substantially the overall length La of the keycap 20 and engages the lower surface side of the keycap 20. The second wire member 70 includes a second beam part 72 that extends along a longer side of the keycap 20 between the switch mechanism 40 and a first longitudinal end (Xa end) of the keycap 20 and engages the lower surface side of the keycap 20. The third wire member 80 includes a third beam part 82 that extends along the longer side of the keycap 20 between the switch mechanism 40 and a second longitudinal end (Xb end) of the keycap 20 and engages the lower surface side of the keycap 20.

The first through third wire members 60, 70, and 80, which are bent similarly into angular C-letter shapes, further include a pair of arm parts 64 and 65, a pair of arm parts 74 and 75, and a pair of arm parts 84 and 85, which extend inward from the corresponding ends of the respective first through third beam parts 62, 72, and 82 at right angles with the first through third beam parts 62, 72, and 82. The respective ends of the arm parts 64 and 65 are bent inward at a right angle to form end parts 66 and 67 of the first wire member 60. Likewise, the respective ends of the arm parts 74 and 75 are bent inward at a right angle to form end parts 76 and 77 of the second wire member 70, and the respective ends of the arm parts 84 and 85 are bent inward at a right angle to form end parts 86 and 87 of the third wire member 80.

According to this embodiment, the first through third wire members 60, 70, and 80 are disposed so that the end part 66 of the first wire member 60 is positioned between the end parts 76 and 77 of the second wire member 70 and the end part 67 of the first wire member 60 is positioned between the end parts 86 and 87 of the third wire member 80.

The first through third wire members 60, 70, and 80 may have the same thickness (diameter). Alternatively, the first wire member 60 larger in overall length may be thicker than the second wire member 70 and the third wire member 80 that are smaller in overall length. In this case, for example, the first wire member 60 may be 1 mm in diameter and the second wire member 70 and the third wire member 80 may be 0.8 mm in diameter.

The switch mechanism 40 includes a linking supporting member 90, a rubber actuator 100, a pair of linking members 110 and 120, and a membrane switch sheet 130.

The supporting plate 50 is formed of a plate of a metal such as an aluminum alloy. The supporting plate 50 has four insertion holes 51 for inserting four engaging leg parts 92 of the linking supporting member 90. The supporting plate 50 includes first supporting parts 52 and 53 configured to support the end parts 66 and 67 of the first wire member 60 in such a manner as to allow the end parts 66 and 67 to turn; second supporting parts 54 and 54 configured to support the end parts 76 and 77 of the second wire member 70 in such a manner as to allow the end parts 76 and 77 to turn; and third supporting parts 56 and 57 configured to support the end parts 86 and 87 of the third wire member 80 in such a manner as to allow the end parts 86 and 87 to turn. The first through third supporting parts 52 through 57 are lanced portions.

Further, the membrane switch sheet 130 adheres to the upper surface of the support plate 50. According to this embodiment, by way of example, the support plate 50 and the membrane switch sheet 130 are provided as separate bodies. Alternatively, for example, the support plate 50 and a membrane switch may be provided as a unitary structure with the contact points of the membrane switch adhering to the surface of the supporting plate 50 so as to be opposed to corresponding keycaps.

The membrane switch sheet 130 has contact points provided at respective positions opposite the keycaps of the keyboard. Further, the membrane switch sheet 130 includes holes (not graphically illustrated) through which the first through third supporting parts 52 through 57 pass.

Here, a description is given of configurations of individual parts of the switch mechanism 40.

Figure 2:
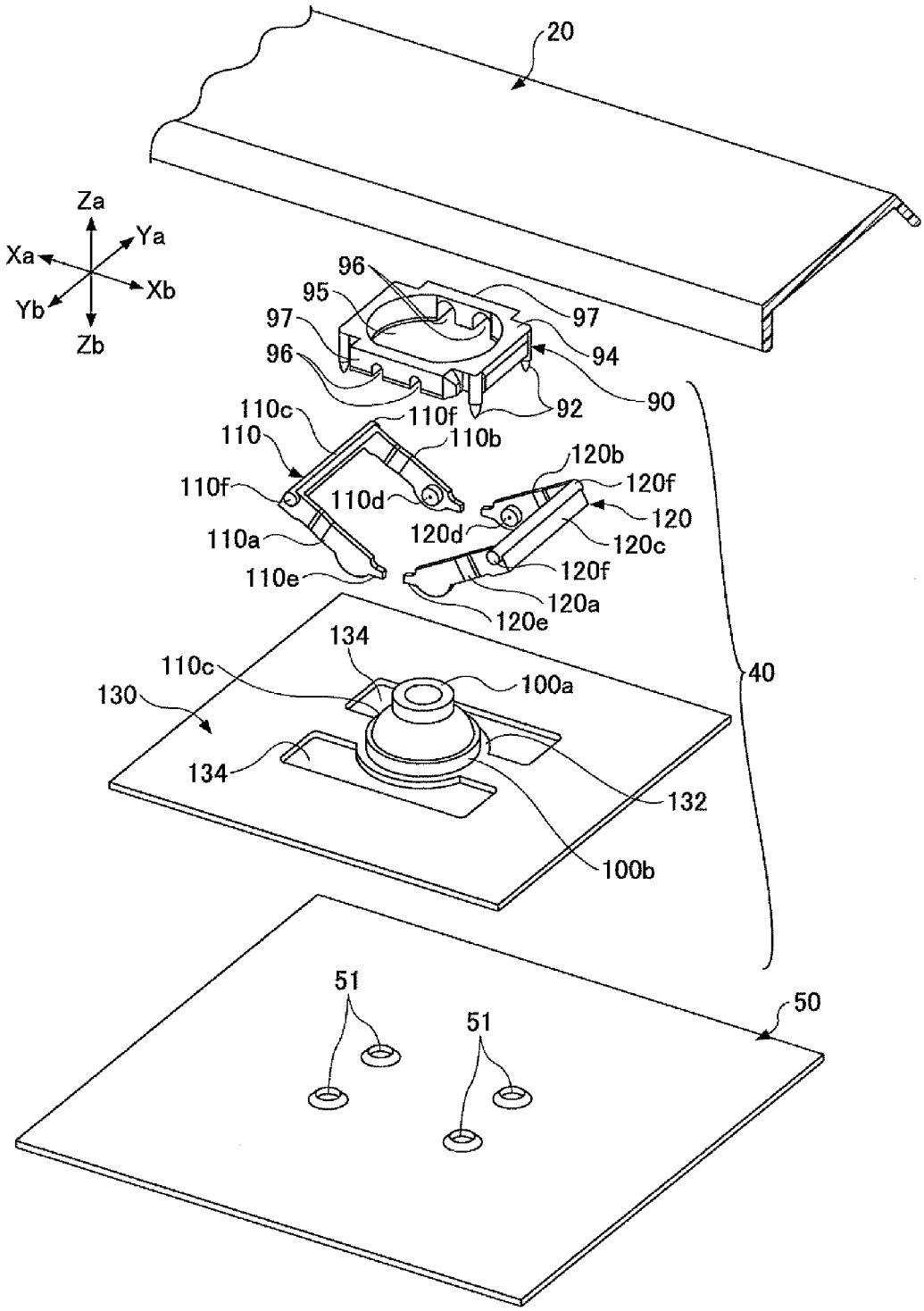
FIG. 2 is an enlarged exploded perspective view of a switch mechanism according to the first embodiment of the present invention.

FIG. 2 is an enlarged exploded perspective view of the switch mechanism 40 according to the first embodiment.

As illustrated in FIG. 2, the linking supporting member 90 includes the engaging leg parts 92, a frame body 94, and multiple recesses 96. In plan view, the frame body 94 surrounds a space 95 through which the rubber actuator 100 is inserted. Further, the engaging leg parts 92 project downward from the lower surface of the frame body 94 at its four corners. The recesses 96, which support the linking members 110 and 120 in such a manner as to allow the linking members 110 and 120 to turn, are provided on the lower surfaces of front and rear sidewalls 97 (on the Ya and the Yb side) of the frame body 94. The engaging leg parts 92 are fixed to the supporting plate 50 on its lower surface side by having their respective end portions deformed after being inserted through the corresponding insertion holes 51 of the supporting plate 50.

The paired linking members 110 and 120 of the switch mechanism 40, each of which is a molded member of a resin material having a unitary structure, turn in an interlocked manner to form a linking mechanism so as to stabilize vertical movements (in the Za and the Zb direction) caused by the pressing of the keycap 20.

The linking member 110 includes a pair of arm parts 110*a* and 110*b* extending in parallel, a connecting part 110*c*, a pair of shaft parts 110*d*, a pair of gear parts 110*e*, and a pair of engaging projections 110*f*. The connecting part 110*c* connects the upper ends of the arm parts 110*a* and 110*b*. The shaft parts 110*d* project laterally (toward each other) from the insides of the lower ends of the arm parts 110*a* and 110*b* to be fit into and turnably supported by the corresponding recesses 96 of the linking supporting member 90. The gear parts 110*e* are provided at the lower ends of the arm parts 110*a* and 110*b*. Each gear part 110*e* includes multiple teeth arranged on a partial circumference of a circle concentric with the corresponding shaft part 110*d*.

The linking member 120 includes a pair of arm parts 120*a* and 120*b* extending in parallel, a connecting part 120*c*, a pair of shaft parts 120*d*, a pair of gear parts 120*e*, and a pair of engaging projections 120*f*. The connecting part 120*c* connects the upper ends of the arm parts 120*a* and 120*b*. The shaft parts 120*d* project laterally (toward each other) from the insides of the lower ends of the arm parts 120*a* and 120*b* to be fit into and turnably supported by the corresponding recesses 96 of the linking supporting member 90. The gear parts 120*e* are provided at the lower ends of the arm parts 120*a* and 120*b*. Each gear part 120*e* includes multiple teeth arranged on a partial circumference of a circle concentric with the corresponding shaft part 120*d*.

Thus, by fitting the shaft parts 110*d*, extending laterally from the insides of the lower ends of the arm parts 110*a* and 110*b*, and the shaft parts 120*d*, extending laterally from the insides of the lower ends of the arm parts 120*a* and 120*b*, into the corresponding recesses 96 of the linking supporting member 90, the linking members 110 and 120 are laterally disposed in symmetry with respect to the rubber actuator 100, and the gear parts 110*e* at the lower ends of the arm parts 110*a* and 110*b* engage the gear parts 120*e* at the lower ends of the arm parts 120*a* and 120*b*, respectively.

Further, the lower ends of the arm parts 110*a* and 110*b* of the linking member 110 and the lower ends of the arm parts 120*a* and 120*b* of the linking member 120 are turnably supported by the linking supporting member 90 fastened on the supporting plate 50, and the upper ends of the arm parts 110*a* and 110*b* of the linking member 110 and the upper ends of the arm parts 120*a* and 120*b* of the linking member 120 engage the keycap 20 on its lower surface side.

The rubber actuator 100 is a molded product having a cylindrical shape that is elastically deformable vertically (in the Za and the Zb direction). The rubber actuator 100 includes an annular small-diameter contact part 100*a* at its upper end. The small-diameter contact part 100*a* comes into contact with the center of the keycap 20 on its lower surface side. Further, the rubber actuator 100 includes a large-diameter contact part 100*b* at its lower end. The large-diameter contact part 100*b* comes into contact with an insulating layer of the membrane switch sheet 130. The rubber actuator 100 includes a hollow tapered part 100 formed between the small-diameter contact part 100*a* and the large-diameter contact part 100*b*.

Further, the rubber actuator 100, which has viscoelasticity due to being a rubber material, elastically deforms to absorb a pressing force when the key is pressed, and generates a restoring force to return the keycap 20 to its upper limit position in response to cancellation of the pressing force.

Referring to FIG. 1 as well, the membrane switch sheet 130 includes a circular contact point part 132 formed between thin insulating sheets (such as PET films). The contact point part 132 includes a pair of electrodes disposed to face each other in a vertical direction so that the contact point part 132 is closed by a pressing force from above. Further, the membrane switch sheet 130 includes a pair of openings 134 for inserting the engaging leg parts 92 and the sidewalls 97 of the frame body 94 of the linking supporting member 90. The openings 134 are provided one on each side of the contact point part 132.

When no pressing force is exerted from above onto the rubber actuator 100, the rubber actuator 100 urges the keycap 20 to its upper limit position above the membrane switch sheet 130 to have the contact point part 132 turned OFF (in a non-conducting state). The rubber actuator 100 is compressed and deformed by a pressing force from above to press the contact point part 132 to switch the contact point part 132 from OFF (non-conducting state) to ON (conducting state).

Figure 3:
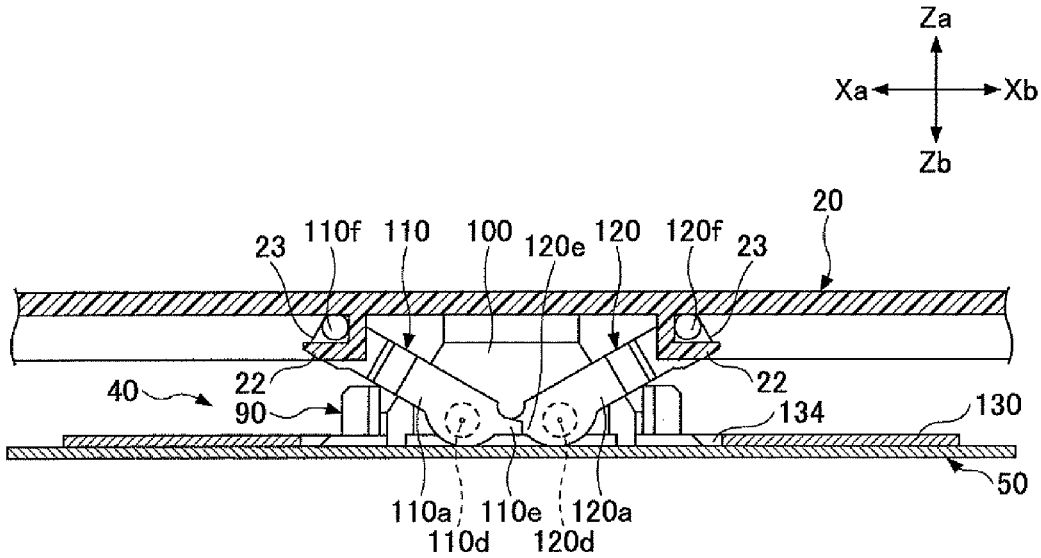
FIG. 3 is a cross-sectional view of part of the key switch unit in the assembled state according to the first embodiment of the present invention.

FIG. 3 is a cross-sectional view of part of the key switch unit 10 in the assembled state.

As illustrated in FIG. 3, when the switch mechanism 40 is OFF (in a non-conducting state), the keycap 20 is urged to its upper limit position above the membrane switch sheet 130 by the rubber actuator 100. Further, the linking members 110 and 120 have their respective arm parts 110*a* and 110*b* and arm parts 120*a* and 120*b* turned obliquely upward in angled positions, and have their respective upper-end engaging projections 110*f* and 120*f* fit into grooves 23 of corresponding L-shaped engaging parts 22 of the keycap 20 projecting from the keycap 20 on its lower surface side. The lateral portions of the engaging parts 22 extend laterally (in the Xa and the Xb direction) enough to maintain the engagement even in the case where the arm parts 110*a*, 110*b*, 120*a*, and 120*b* turn or the engaging projections 110*f* and 120*f* slide in the Xa or the Xb direction.

Further, the keycap 20 has a fitting part 160 (FIG. 7) projecting in the center on its lower surface side. The fitting part 160 fits to the small-diameter contact part 100*a* of the rubber actuator 100. This fitting part 160 prevents the small-diameter contact part 100*a* of the rubber actuator 100 from being displaced.

Here, a description is given of operations of individual parts of the switch mechanism 40.

Figure 4A:
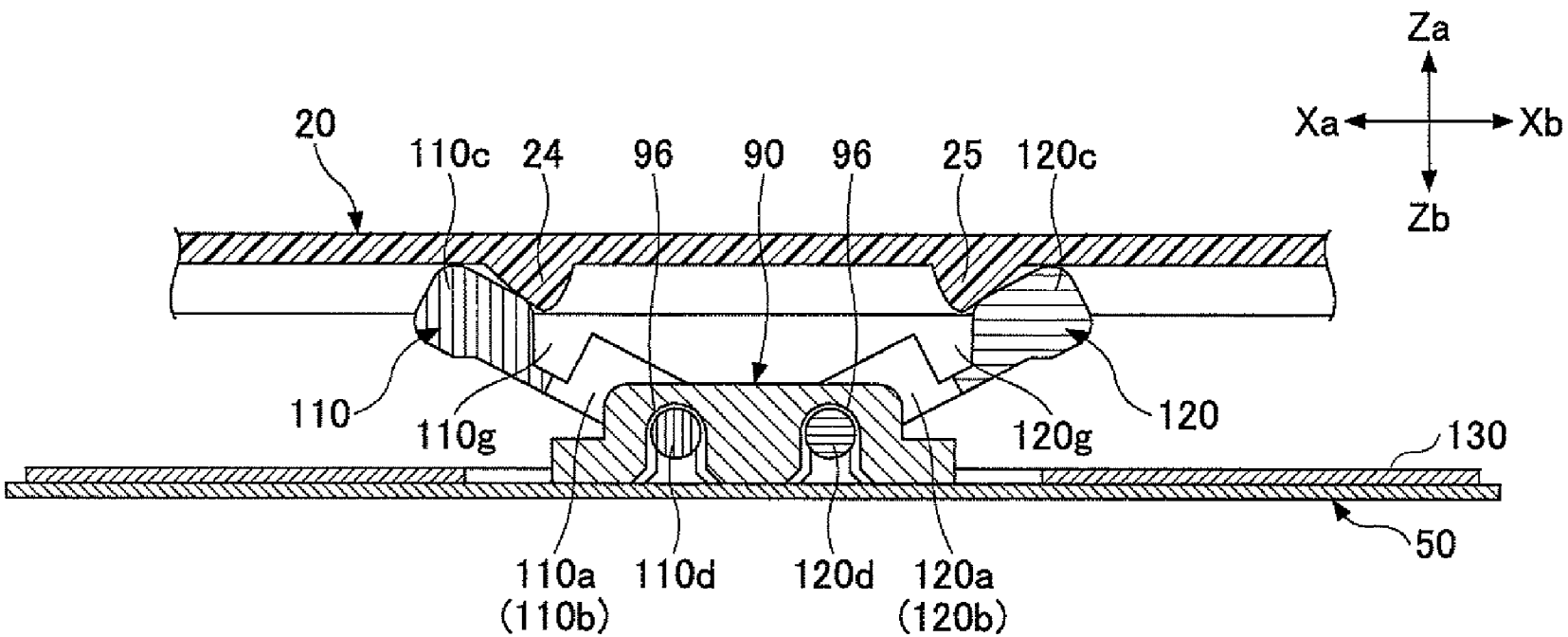
FIG. 4A is a cross-sectional view of part of the key switch unit, illustrating an operating state of linking members when the switch mechanism is OFF, according to the first embodiment of the present invention.

FIG. 4A is a cross-sectional view of part of the key switch unit 10, illustrating an operating state of the linking members 110 and 120 when the switch mechanism 40 of the first embodiment is OFF.

Figure 4B:
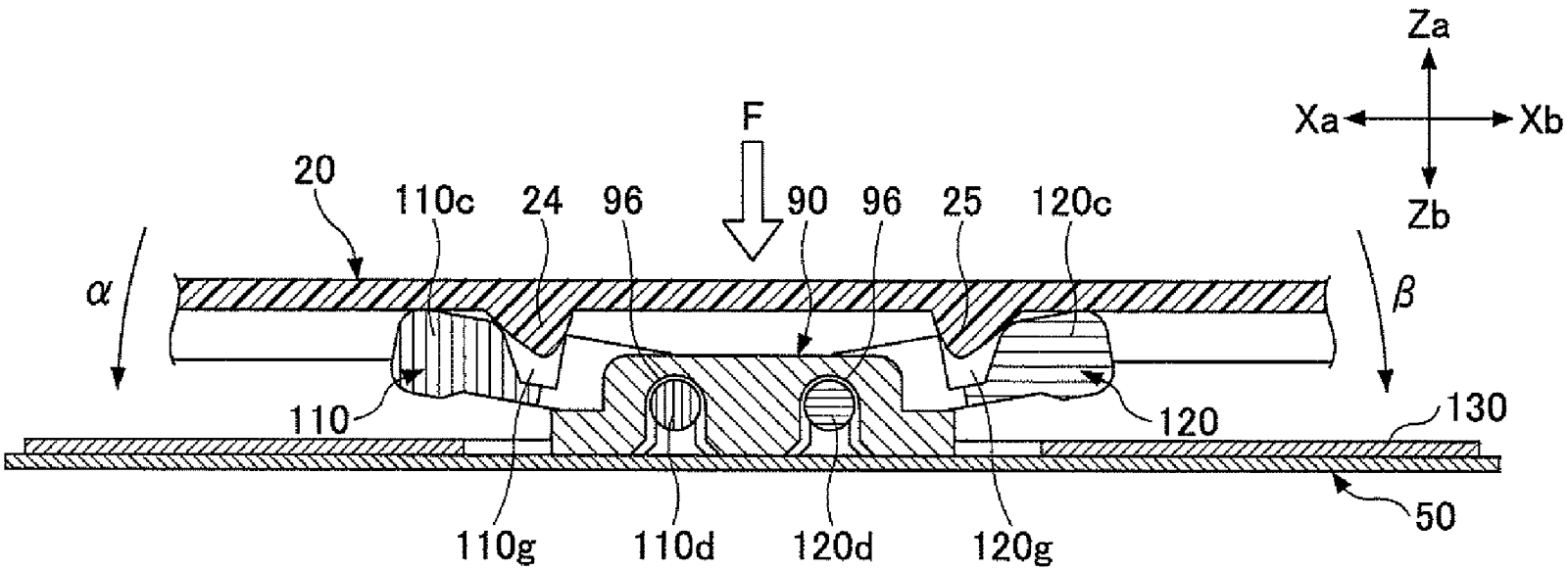
FIG. 4B is a cross-sectional view of part of the key switch unit, illustrating an operating state of the linking members when the pressing of a keycap starts, according to the first embodiment of the present invention.

FIG. 4B is a cross-sectional view of part of the key switch unit 10, illustrating an operating state of the linking members 110 and 120 when the pressing of the keycap 20 of the first embodiment starts.

Figure 4C:
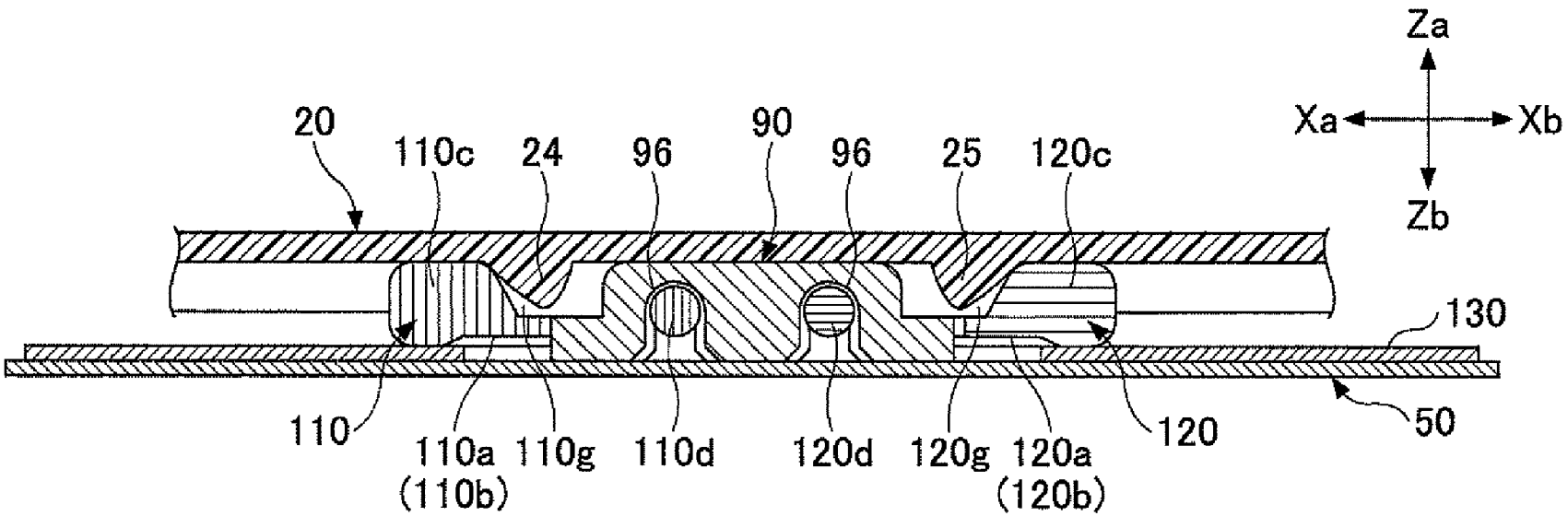
FIG. 4C is a cross-sectional view of part of the key switch unit, illustrating an operating state of the linking members when the keycap is pressed to its lower limit position, according to the first embodiment of the present invention.

FIG. 4C is a cross-sectional view of part of the key switch unit 10, illustrating an operating state of the linking members 110 and 120 when the keycap 20 of the first embodiment is pressed to its lower limit position.

As illustrated in FIG. 4A, when the keycap 20 is not operated, the linking members 110 and 120 are turned obliquely upward and are stationary in angled positions. The linking members 110 and 120 have recesses 110*g* and 120*g* provided on the upper sides of the arm parts 110*a* and 110*b* and the arm parts 120*a* and 120*b*, respectively. Further, the keycap 20 has projecting parts 24 and 25 provided on its lower surface side. The projecting parts 24 and 25 fit into the recesses 110*g* and 120*g*, respectively, as the keycap 20 moves downward to turn the linking members 110 and 120.

As illustrated in FIG. 4B, when the upper surface of the keycap 20 is pressed downward, the keycap 20 is moved downward (in the Zb direction) by the pressing force, which is indicated by arrow F in FIG. 4B. As a result, the linking members 110 and 120, which have the gear parts 110*e* and 120*e* engaging each other, simultaneously turn in directions indicated by arrow α and arrow β (hereinafter, the α direction and the β direction), respectively, in FIG. 4B with the engaging projections 110*f* and 120*f* sliding in the grooves 23 of the engaging parts 22. At this point, the linking members 110 and 120 turn in the α direction and the β direction with the shaft parts 110*d* and 120*d* serving as centers of turning, respectively, the shaft parts 110*d* and 120*d* being fit into the recesses 96 of the linking supporting member 90 fastened to the supporting plate 50 through the insertion holes 51 (FIG. 2).

As a result, the linking members 110 and 120 press the engaging parts 22 of the keycap 20 downward as the linking members 110 and 120 simultaneously turn in the α direction and the β direction, respectively. As a result of the linking members 110 and 120 turning in conjunction with each other, the center portion of the keycap 20 moves downward in a horizontal position without tilting to compress the rubber actuator 100 vertically downward. Thus, since the linking members 110 and 120 simultaneously turn to press the engaging parts 22 provided on the lower surface of the keycap 20 downward, the center portion of the keycap 20 in its lengthwise directions moves downward, keeping its horizontal position without tilting, even if the keycap 20 is pressed at a position off its center portion.

Further, while the linking members 110 and 120 simultaneously turn in the α direction and the β direction, respectively, the projecting parts 24 and 25 projecting from the keycap 20 on its lower surface side have respective end portions fit into the recesses 110*g* and 120*g* of the linking members 110 and 120, respectively. This limits the positions of the linking members 110 and 120 relative to the lower surface side of the keycap 20.

As illustrated in FIG. 4C, the rubber actuator 100, which has been pressed by the downward movement of the keycap 20, presses the contact point part 132 (FIG. 1) of the membrane switch sheet 130 to turn ON the contact point part 132. With this, the linking members 110 and 120 turn to stop in a substantially horizontal position. As a result, the switch mechanism 40 is switched ON (switched to a conducting state).

Here, a description is given of an attachment structure of the first through third wire members 60, 70, and 80 forming the key reinforcement mechanism 30 of this embodiment.

Figure 5:
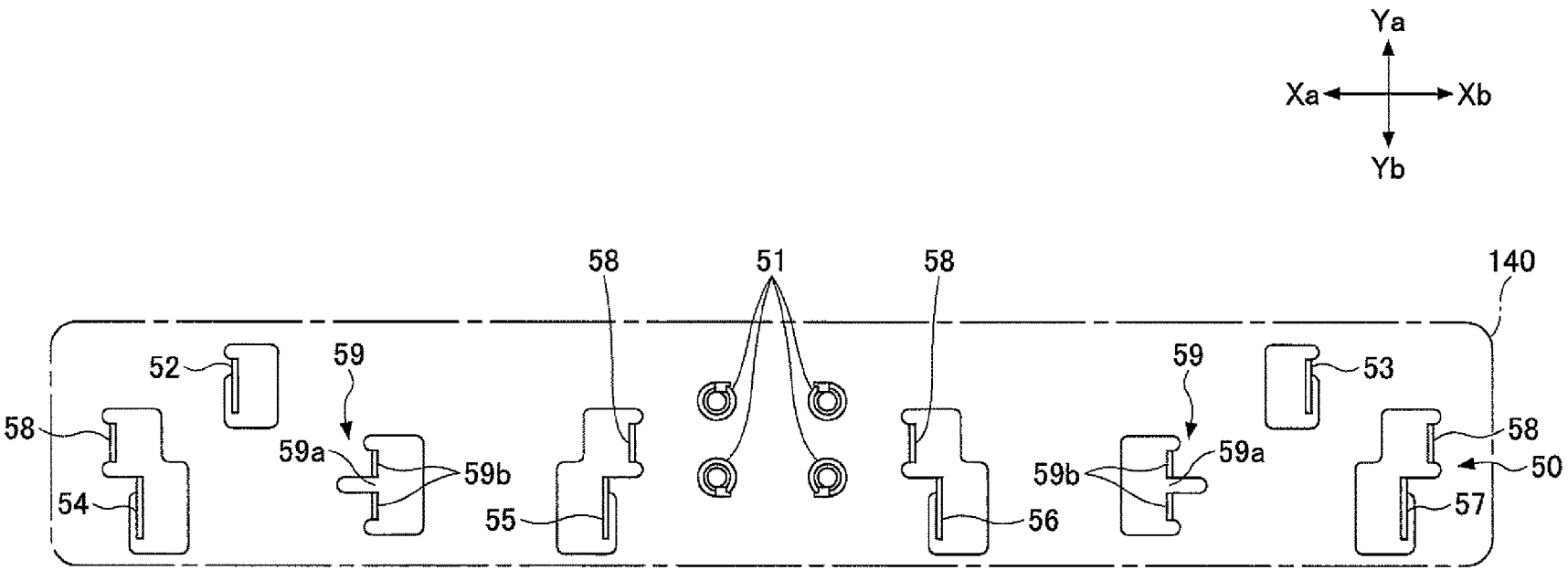
FIG. 5 is a plan view of part of a supporting plate, illustrating a configuration thereof, according to the first embodiment of the present invention.

FIG. 5 is a plan view of part of the supporting plate 50, illustrating a configuration thereof, according to the first embodiment.

Referring to FIG. 5 as well as FIG. 1, the four insertion holes 51, the supporting parts 52 through 57 that support the first through third wire members 60, 70, and 80, wire holders 58, and key guides 59 are provided in a key attachment region 140 of the supporting plate 50 facing the keycap 20. The insertion holes 51, the supporting parts 52 through 57, the wire holders 58, and the key guides 59 are symmetrically arranged with respect to the center of the keycap 20 in the lateral directions (the Xa and the Xb direction). As a result, the wire members 60, 70, and 80 are disposed in bilateral symmetry with respect to the center of the keycap 20 in the lateral directions.

The linking supporting member 90 is fixed with the engaging leg parts 92 of the linking supporting member 90 being inserted into the insertion holes 51. The supporting parts 52 through 57 are hook-shaped or have an inverse L-letter shape (as illustrated in FIG. 1) to define hook holes (spaces) 52*a*, 53*a*, 54*a*, 55*a*, 56*a*, and 57*a* extending in the front and the rear direction (the Ya and the Yb direction). The end parts 66 and 67 of the first wire member 60, the end parts 76 and 77 of the second wire member 70, and the end parts 86 and 87 of the third wire member 80 are inserted through the hook holes 52*a* and 53*a*, the hook holes 54*a* and 55*a*, and the hook holes 56*a* and 57*a*, respectively.

The wire holders 58 are limiting members that limit the attachment positions of the arm parts 74 and 75 of the second wire member 70 and the arm parts 84 and 85 of the third wire member 80 in the lateral directions (the Xa and the Xb direction).

Each of the key guides 59 has a pair of vertical parts 59*b*, arranged side by side in the front and the rear directions, and a slit 59*a* provided between the vertical parts 59*b*. The slit 59*a* extends partly in the vertical directions (the Za and the Zb direction) and also partly in the lateral directions (the Xa and the Xb direction) in the supporting plate 50. Ribs 170*c* and 171*c* (FIG. 7 and FIG. 8) projecting downward from the keycap 20 on its lower surface side are fit into the corresponding slits 59*a*.

Figure 6:
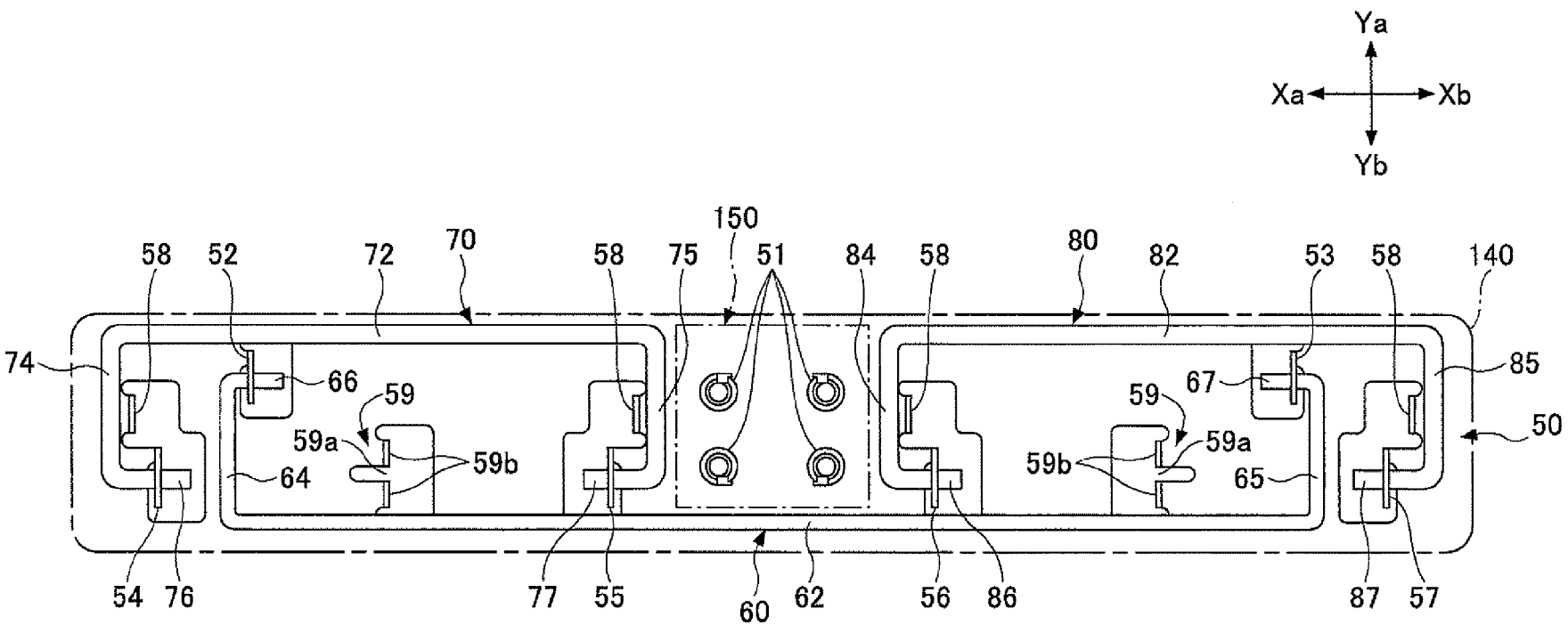
FIG. 6 is a plan view of part of the supporting plate, illustrating an arrangement of first through third wire members, according to the first embodiment of the present invention.

FIG. 6 is a plan view of part of the supporting plate 50, illustrating an arrangement of the first through third wire members 60, 70, and 80 of the first embodiment.

As illustrated in FIG. 6, the first through third wire members 60, 70, and 80 have their respective end parts 66 and 67, 76 and 77, and 86 and 87 inserted (passed) through the hook holes 52*a* and 53*a* of the supporting parts 52 and 53, the hook holes 54*a* and 55*a* of the supporting parts 54 and 55, and the hook holes 56*a* and 57*a* of the supporting parts 56 and 57, respectively. As illustrated in FIG. 1, the hook holes 52*a* through 57*a* are rectangular recesses that extend in the Ya and the Yb directions and are open at the Yb ends. Therefore, the end parts 66, 67, 76, 77, 86, and 87 are inserted (passed) through the hook holes 52*a* through 57*a* easily by sliding the end parts 66, 67, 76, 77, 86, and 87 from the Yb side to the Ya side.

According to this embodiment, the first wire member 60 larger in overall length has the first beam part 62 provided on the Yb side in the key attachment region 140, and the second wire member 70 and the third wire member 80 that are smaller in overall length have their respective second and third beam parts 72 and 82 provided on the Ya side in the key attachment region 140. Further, the second wire member 70 is provided on the left side (Xa side) in the key attachment region 140, and the third wire member 80 is provided on the right side (Xb side) in the key attachment region 140.

The wire members 70 and 80 are provided outside a switch region 150 where the switch mechanism 40 is provided in the key attachment region 140. Accordingly, in the switch region 150, the first beam part 62 of the first wire member 60 is provided on one side (the Yb side), but no wire member is provided on the other side (the Ya side) in the front and the rear direction. As a result, compared with the case of providing a wire member on each side in the front and the rear direction, the key attachment region 140, which corresponds in shape to the outline of the keycap 20, is reduced in width (the dimension in the front [Ya] and the rear [Yb] direction) by the size of one wire member.

Here, a description is given of a configuration of the keycap 20 on its lower surface side.

Figure 7:
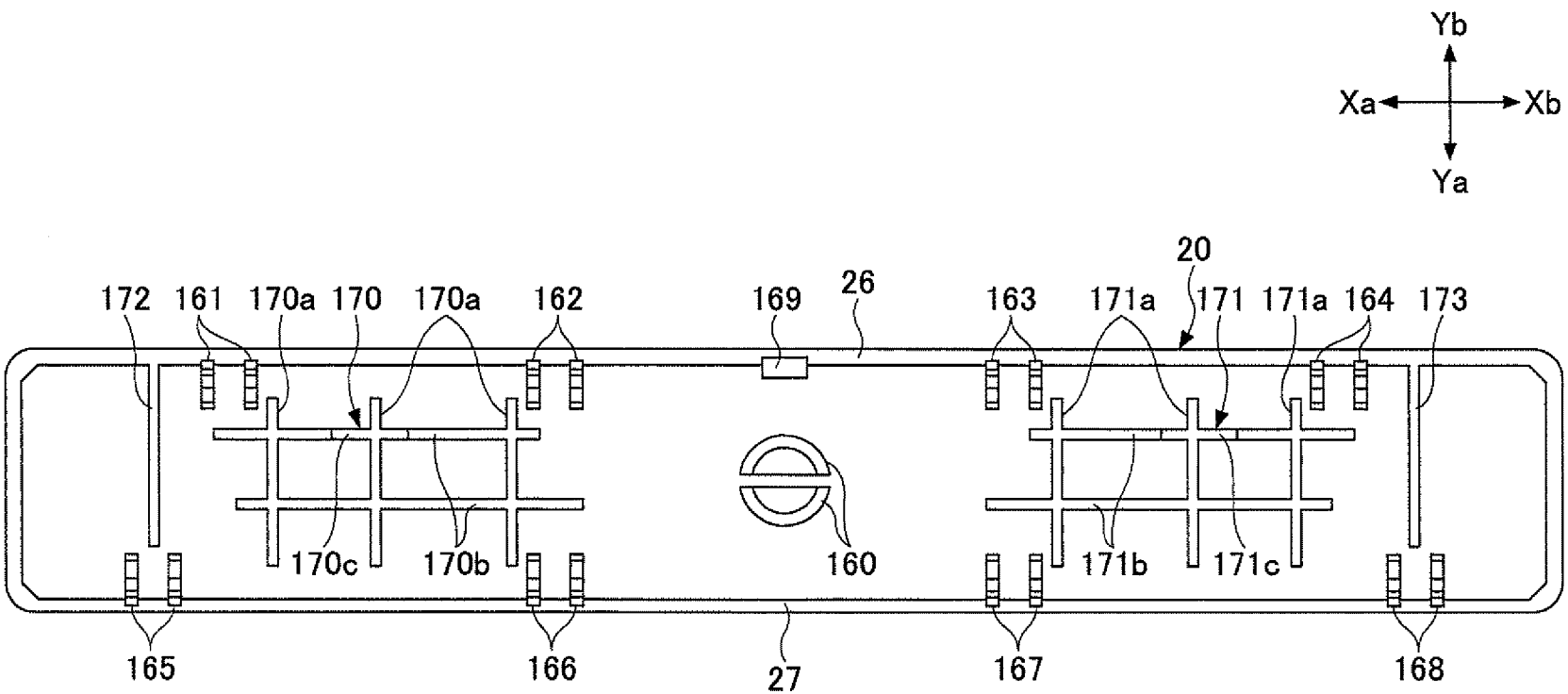
FIG. 7 is a bottom plan view of the keycap according to the first embodiment of the present invention.

FIG. 7 is a bottom plan view of the keycap 20 according to the first embodiment.

As illustrated in FIG. 7, the keycap 20 is molded to have the fitting part 160, wire engaging parts 161, 162, 163, 164, 165, 166, 167, and 168, a wire contact part 169, ribs 170 and 171, and partitions 172 and 173 as a unitary structure on its lower surface side.

The fitting part 160 includes a pair of projections, which are arc-shaped when viewed from the bottom side. The fitting part 160 is fit to the periphery of the small-diameter contact part 100*a* of the rubber actuator 100 to limit the position of the small-diameter contact part 100*a*, thereby preventing the rubber actuator 100 from being displaced.

Figure 8:
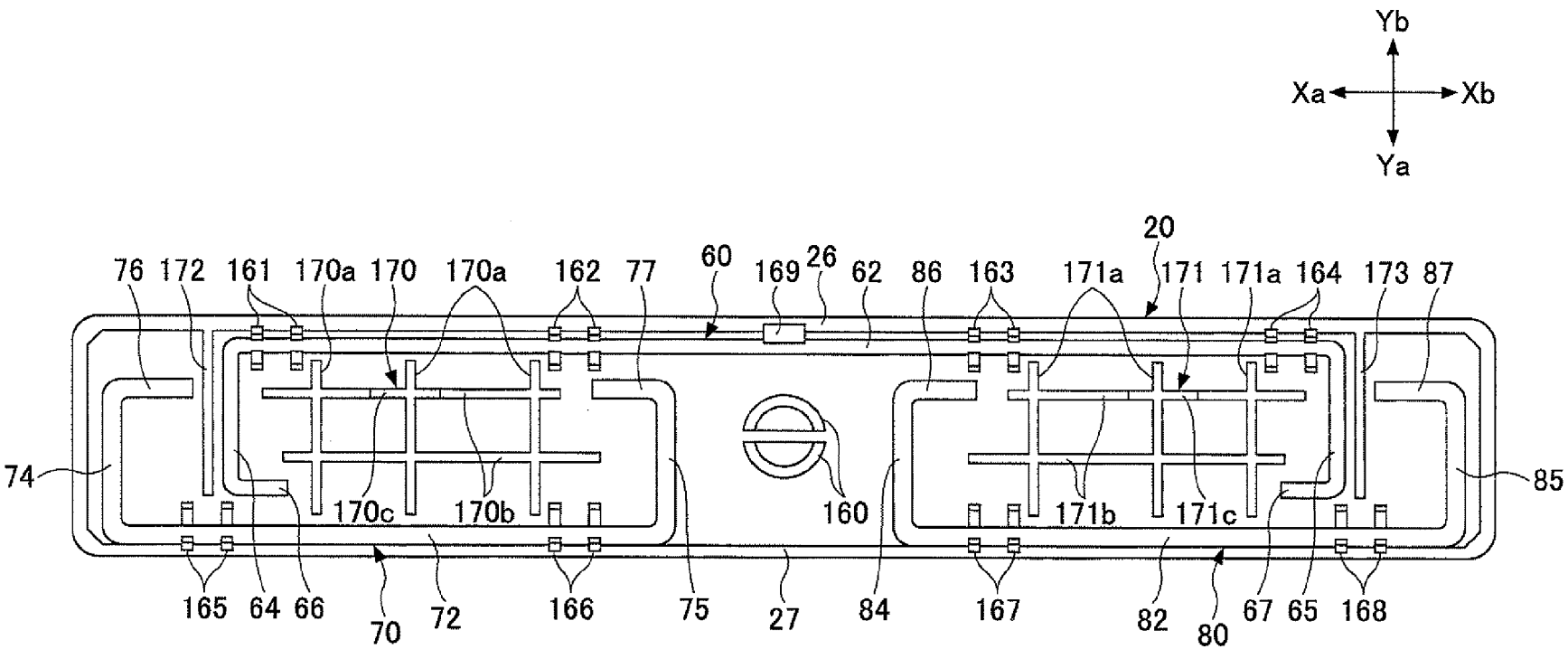
FIG. 8 is a bottom plan view of the keycap to which the first through third wire members are attached on its lower surface side according to the first embodiment of the present invention.

FIG. 8 is a bottom plan view of the keycap 20 of the first embodiment, to which the first through third wire members 60, 70, and 80 are attached on its lower surface side.

As illustrated in FIG. 8, the first through third beam parts 62, 72, and 82 of the first through third wire members 60, 70, and 80 engage the wire engaging parts 161 through 164, the wire engaging parts 165 and 166, and the wire engaging part 167 and 168, respectively, which are formed as a unitary structure on the lower surface side of the keycap 20. The wire engaging parts 161 through 168 have respective U-shaped grooves 180 (FIG. 10A, FIG. 10B, FIG. 11A, and FIG. 11B), which are open on the Zb side (in the downward direction).

The wire contact part 169 is in contact with an intermediate portion of the first beam part 62 of the first wire member 60 to prevent the first beam part 62 from bending.

The ribs 170 and 171 include respective three wall parts 170*a* and 171*a* and respective two wall parts 170*b* and 171*b*, which extend in the front and the rear direction (the Ya and the Yb direction) and in the lateral directions (the Xa and the Xb direction), respectively, to cross each other, so that the ribs 170 and 171 each have a lattice shape to increase the strength of the keycap 20 on its lower surface side. The wall parts 170*b* and 171*b* include the respective projecting parts 170*c* and 171*c*, which project downward to be fit into the corresponding slits 59*a* of the key guides 59 (FIG. 5). As a result, the keycap 20 is guided in the directions of its upward movement and downward movement, so that movements other than the upward and the downward movement of the keycap 20 are restricted in order to prevent the keycap 20 from pivoting on the rubber actuator 100.

The Xa-side partition 172 separates the arm part 64 of the first wire member 60 and the end part 76 of the second wire member 70 from each other to prevent the wire members 60 and 70 from coming into contact (interfering) with each other. Further, the Xb-side partition 173 separates the arm part 65 of the first wire member 60 and the end part 87 of the third wire member 80 from each other to prevent the wire members 60 and 80 from coming into contact (interfering) with each other.

Although the keycap 20 is molded to be reduced in thickness (for example, less than or equal to 1 mm) in its top portion in order to be thinner, the strength of the keycap 20 is increased on each of the Ya side and the Yb side because the first through third beam parts 62, 72, and 82 of the first through third wire members 60, 70, and 80, respectively, engage the wire engaging parts 161 through 168 provided on the longer sides of the keycap 20 on its lower surface side.

Therefore, even if the keycap 20 having an elongated shape (in the Xa and the Xb direction) is pressed in a part off its center portion (for example, near the Xa or Xb end), it is possible to prevent the keycap 20 from bending or pivoting on its part contacting the rubber actuator 100.

Further, a Yb-side edge part 26 of the keycap 20 is reinforced over substantially its overall length by the beam part 62 of the wire member 60, while a Ya-side edge part 27 of the keycap 20, except for its portion corresponding to the center and its neighborhood of the keycap 20 (the region contacted by the rubber actuator 100) in its lengthwise directions (the Xa and the Xb direction), is reinforced by the beam parts 72 and 82 of the wire members 70 and 80. Thus, no wire member is provided around the center of the Ya-side edge part 27 in the lengthwise directions. Accordingly, the keycap 20 is reduced in size in the front and the rear direction (the Ya and the Yb direction) by the diameter of a wire member. Thus, the keycap 20 is reduced in size and at the same time is compensated for reduction in strength due to thinning by engaging the beam parts 62, 72, and 82 of the wire members 60, 70, and 80 with the keycap 20 on its lower surface side.

Here, a description is given of the upward and the downward movement of the key switch unit 10.

Figure 9A:
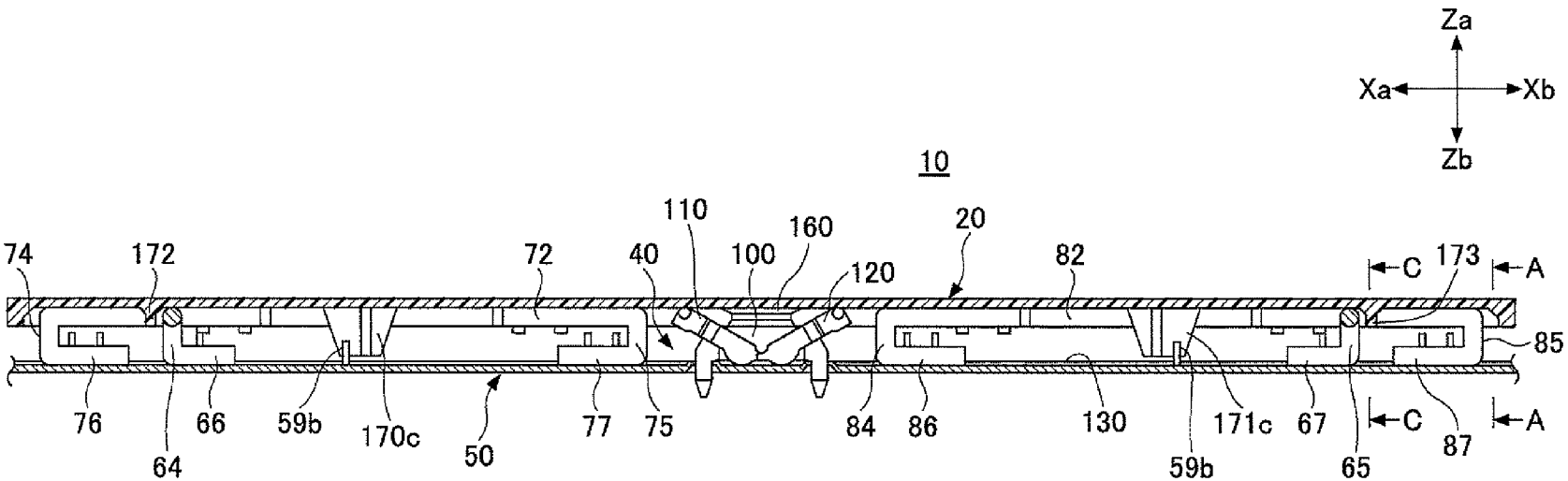
FIG. 9A is a front-side sectional view of the key switch unit in a pre-operation state according to the first embodiment of the present invention.
Figure 9B:
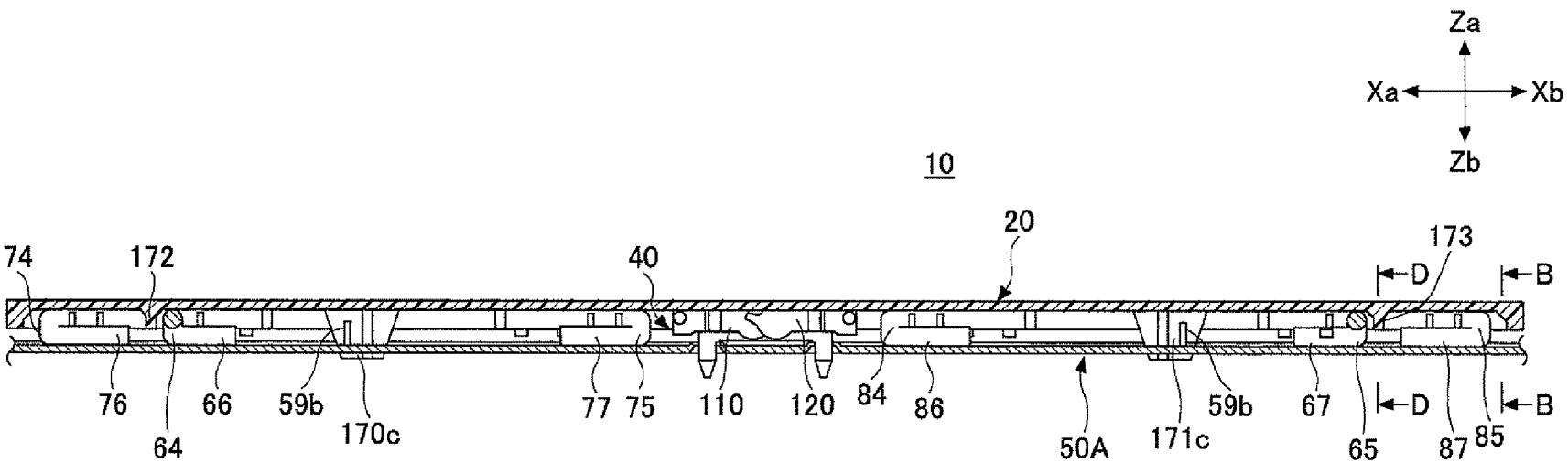
FIG. 9B is a front-side sectional view of the key switch unit in a pressed state according to the first embodiment of the present invention.
Figure 10A:
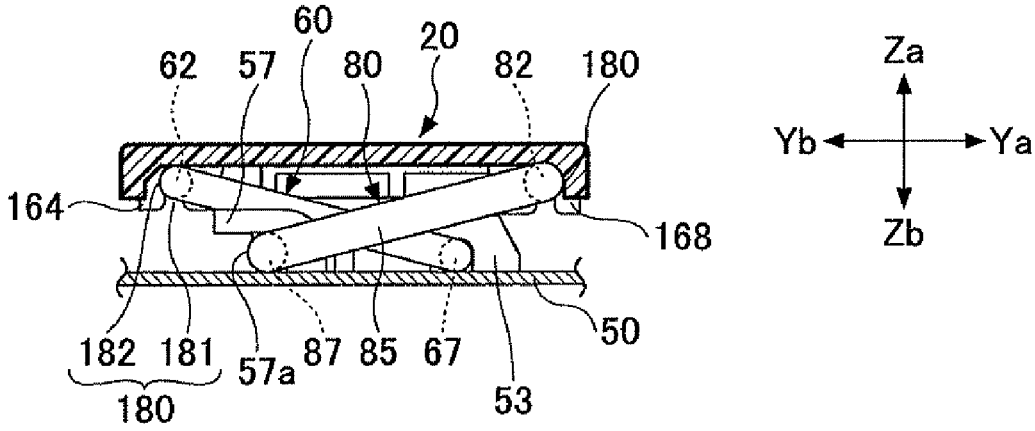
FIG. 10A is a cross-sectional view of the key switch unit taken along line A-A in FIG. 9A according to the first embodiment of the present invention.
Figure 10B:
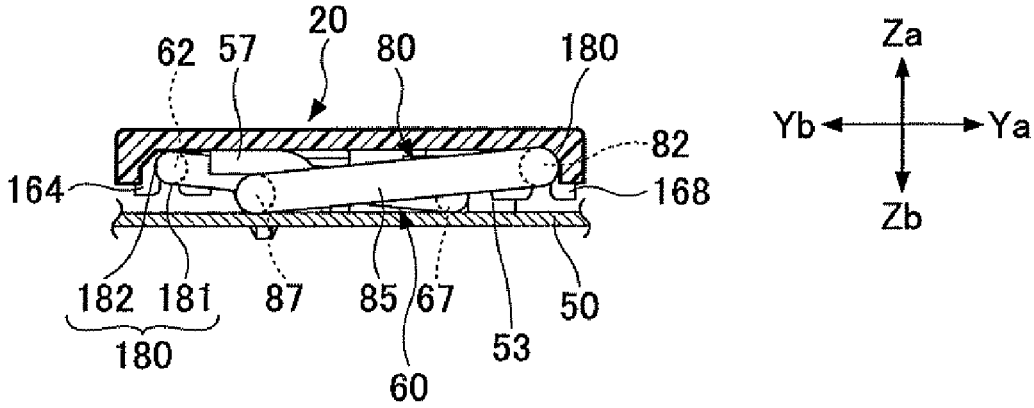
FIG. 10B is a cross-sectional view of the key switch unit taken along line B-B in FIG. 9B according to the first embodiment of the present invention.
Figure 11A:
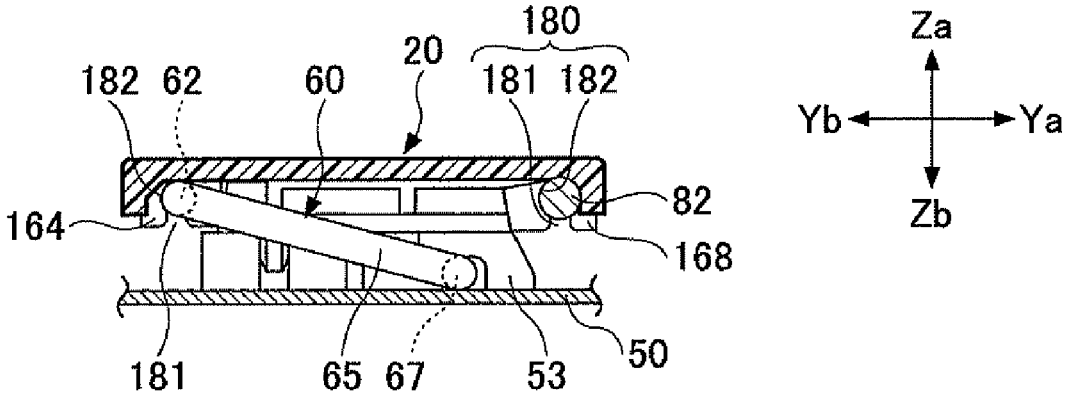
FIG. 11A is a cross-sectional view of the key switch unit taken along line C-C in FIG. 9A according to the first embodiment of the present invention.
Figure 11B:
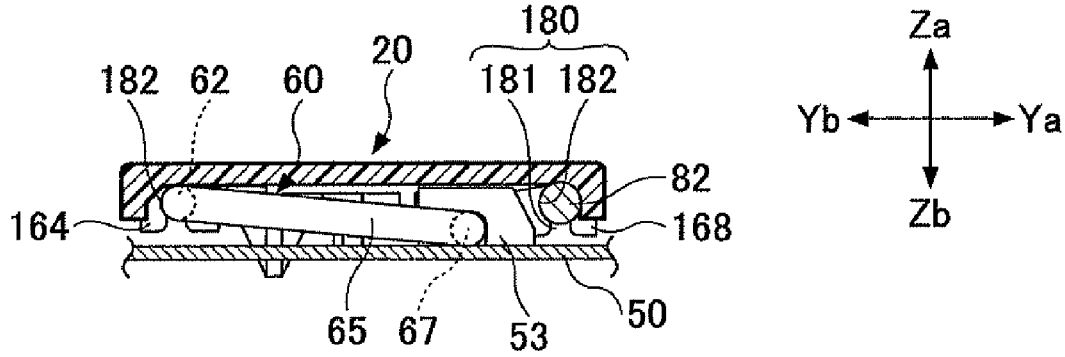
FIG. 11B is a cross-sectional view of the key switch unit taken along line D-D in FIG. 9B according to the first embodiment of the present invention.

FIG. 9A is a front-side sectional view of the key switch unit 10 of the first embodiment in a pre-operation state. FIG. 9B is a front-side sectional view of the key switch unit 10 of the first embodiment in a pressed state. FIG. 10A is a cross-sectional view of the key switch unit 10 taken along line A-A in FIG. 9A. FIG. 10B is a cross-sectional view of the key switch unit 10 taken along line B-B in FIG. 9B. FIG. 11A is a cross-sectional view of the key switch unit 10 taken along line C-C in FIG. 9A. FIG. 11B is a cross-sectional view of the key switch unit 10 taken along line D-D in FIG. 9B.

Referring to FIG. 9A, FIG. 10A, and FIG. 11A as well as FIG. 8, the keycap 20 has its center portion in the lengthwise direction (the Xa and the Xb direction) supported at its upper limit position above the membrane switch sheet 130 by the rubber actuator 100 and the linking members 110 and 120 of the switch mechanism 40, and has the Yb-side edge part 26 and the Ya-side edge part 27 (FIG. 8) supported along the length of the keycap 20 by the wire members 60, 70, and 80.

The first through third beam parts 62, 72, and 82 of the first through third wire members 60, 70, and 80 engage the U-shaped grooves 180 of the corresponding wire engaging parts 161 through 168, which are formed into a unitary structure on the lower surface side of the keycap 20. Each of the U-shaped grooves 180 has a bottom (Zb-side) opening 181 and a circular recess 182 communicating with the opening 181. The width (size in the Ya and the Yb direction) of the openings 181 of the U-shaped grooves 180 is slightly smaller than the diameters of the first through third wire members 60, 70, and 80. Accordingly, once the beam parts 62, 72, and 82 of the wire members 60, 70, and 80 are press-fit into the circular recesses 182 of the corresponding U-shaped grooves 180, the U-shaped grooves 180 hold the beam parts 62, 72, and 82 so that the beam parts 62, 72, and 82 are prevented from falling off.

Accordingly, at the time of assembly, it is possible to simultaneously engage the beam parts 62, 72, and 82 of the wire members 60, 70, and 80 with the U-shaped grooves 180 of the corresponding wire engaging parts 161 through 168 by inserting (passing) the end parts 66, 67, 76, 77, 86, and 87 of the wire members 60, 70, and 80 through the hook holes 52*a* through 57*a* of the supporting parts 52 through 57 as illustrated in FIG. 6 and thereafter moving down the keycap 20 from above. That is, according to this embodiment, an increase in the number of wire members does not increase assembly manhours, thus making it possible to perform assembling with efficiency.

Further, the end parts 66, 67, 76, 77, 86, and 87 of the wire members 60, 70, and 80 are inserted (passed) through the hook holes 52*a* through 57*a* of the supporting parts 52 through 57 rising up from the supporting plate 50, and the arm parts 64, 65, 74, 75, 84, and 85 of the wire members 60, 70, and 80 are inclined in angled positions, extending obliquely upward relative to the supporting plate 50, and connect the end parts 66, 67, 76, 77, 86, and 87 and the beam parts 62, 72, and 82.

Therefore, in conjunction with the upward and the downward movement of the keycap 20, the wire members 60, 70, and 80 turn on the end parts 66 and 67, the end parts 76 and 77, and the end parts 86 and 87, respectively, which serve as rotation shafts. Thus, the keycap 20 has the Yb-side edge part 26 and the Ya-side edge part 27 supported over the overall length in the lengthwise directions by the wire members 60, 70 and 80.

As illustrated in FIG. 9B, FIG. 10B, and FIG. 11B, when the upper surface of the keycap 20 is pressed downward, the wire members 60, 70, and 80 turn on the end parts 66 and 67, the end parts 76 and 77, and the end parts 86 and 87, respectively, so that the keycap 20 moves down to its lower limit position while keeping its horizontal position. Further, the keycap 20 has the Yb-side edge part 26 and the Ya-side edge part 27 supported by the beam parts 62, 72, and 82 of the wire members 60, 70, and 80, and the beam parts 62, 72, and 82 are supported through the arm parts 64 and 65, the arm parts 74 and 75, and the arm parts 84 and 85, respectively. Therefore, whichever part in the lengthwise directions is pressed, the keycap 20 moves down to its lower limit position while keeping the same horizontal position. This makes it possible to increase the reliability of a switching operation while reducing the keycap 20 in thickness and size.

[b] Second Embodiment

Figure 12:
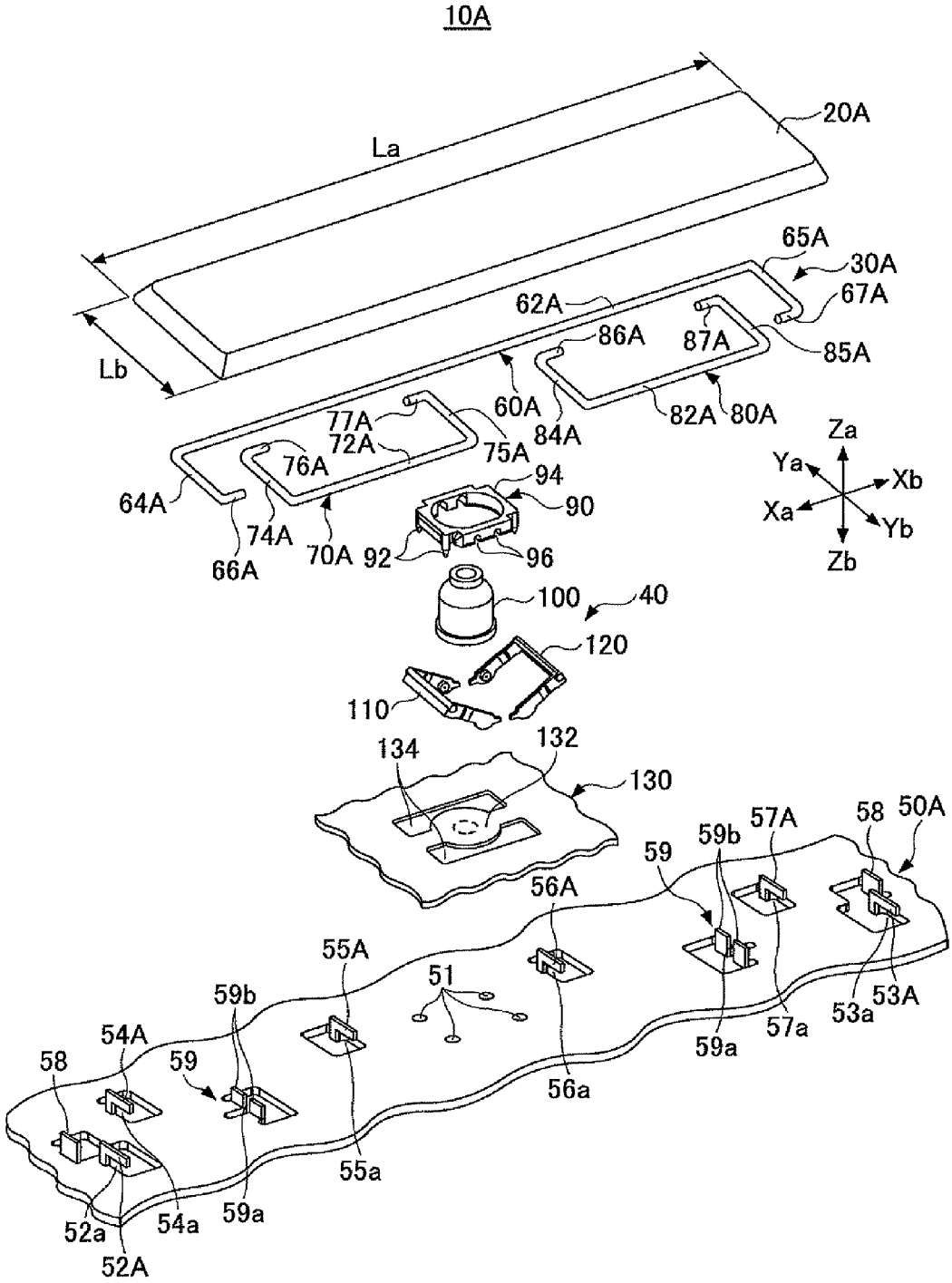
FIG. 12 is an exploded perspective view of part of a key switch unit, illustrating a configuration thereof, according to a second embodiment of the present invention.

FIG. 12 is an exploded perspective view of part of a key switch unit 10A, illustrating a configuration thereof, according to a second embodiment of the present invention. In the second embodiment, the same elements as those of the first embodiment are referred to by the same reference numerals, and a description thereof is omitted.

Referring to FIG. 12, the key switch unit 10A of the second embodiment is different in wire member arrangement from the key switch unit 10 of the first embodiment.

According to this embodiment, the key switch unit 10A includes a keycap 20A, a key reinforcement mechanism 30A, the switch mechanism 40, and a supporting plate 50A. The key reinforcement mechanism 30A includes a first wire member 60A, a second wire member 70A, and a third wire member 80A. The first through third wire members 60A, 70A, and 80A are arranged so that the wire members 70A and 80A, which are smaller in overall length than the wire member 60A, are positioned between end parts 66A and 67A of the first wire member 60A.

Here, a description is given of an attachment structure of the first through third wire members 60A, 70A, and 80A forming the key reinforcement mechanism 30A of this embodiment.

Figure 13:
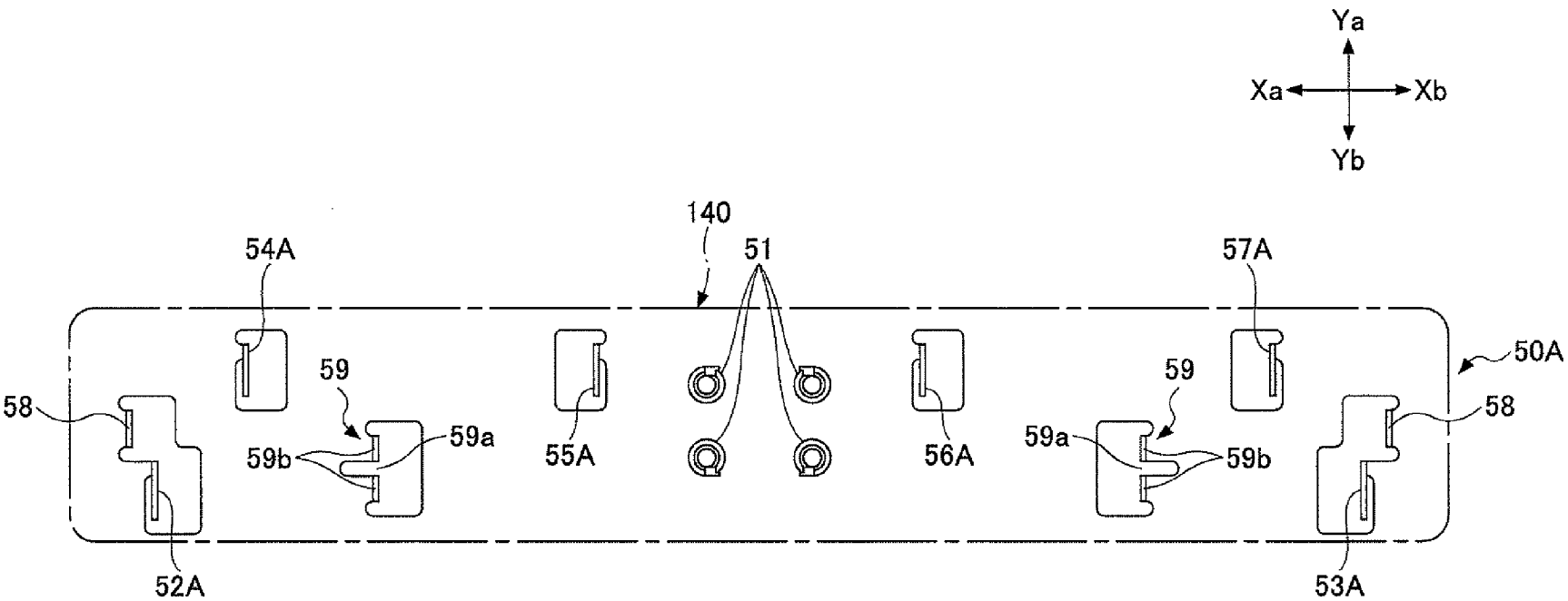
FIG. 13 is a plan view of part of a supporting plate, illustrating a configuration thereof, according to the second embodiment of the present invention.

FIG. 13 is a plan view of part of the supporting plate 50A, illustrating a configuration thereof, according to the second embodiment.

Referring to FIG. 13 as well as FIG. 12, the four insertion holes 51, first supporting parts 52A and 53A that support the end parts 66A and 67A, respectively, of the first wire member 60A, second supporting parts 54A and 55A that support end parts 76A and 77A, respectively, of the second wire member 70A, third supporting parts 56A and 57A that support end parts 86A and 87A, respectively, of the third wire member 80A, the wire holders 58, and the key guides 59 are provided in the key attachment region 140 of the supporting plate 50A facing the keycap 20A. The insertion holes 51, the supporting parts 52A through 57A, the wire holders 58, and the key guides 59 are symmetrically arranged with respect to the center of the keycap 20A in the lateral directions (the Xa and the Xb direction). As a result, the wire members 60A, 70A, and 80A are disposed in bilateral symmetry with respect to the center of the keycap 20A in the lateral directions.

The linking supporting member 90 is fixed with the engaging leg parts 92 of the linking supporting member 90 being inserted into the insertion holes 51. The supporting parts 52A through 57A are hook-shaped or have an inverse L-letter shape (as illustrated in FIG. 12) to define the hook holes (spaces) 52*a*, 53*a*, 54*a*, 55*a*, 56*a*, and 57*a* extending in the front and the rear direction (the Ya and the Yb direction). The end parts 66A and 67A of the first wire member 60A, the end parts 76A and 77A of the second wire member 70A, and the end parts 86A and 87A of the third wire member 80A are inserted through the hook holes 52*a* and 53*a*, the hook holes 54*a* and 55*a*, and the hook holes 56*a* and 57*a*, respectively.

The wire holders 58 are limiting members that limit the attachment positions of arm parts 64A and 65A of the first wire member 60A in the lateral directions (the Xa and the Xb direction).

Each of the key guides 59 has the vertical parts 59*b*, arranged side by side in the front and the rear directions, and the slit 59*a* provided between the vertical parts 59*b*. The slit 59*a* extends partly in the vertical directions (the Za and the Zb direction) and also partly in the lateral directions (the Xa and the Xb direction) in the supporting plate 50. The ribs 170*c* and 171*c* (FIG. 15 and FIG. 16) projecting downward from the keycap 20A on its lower surface side are fit into the corresponding slits 59*a*.

Figure 14:
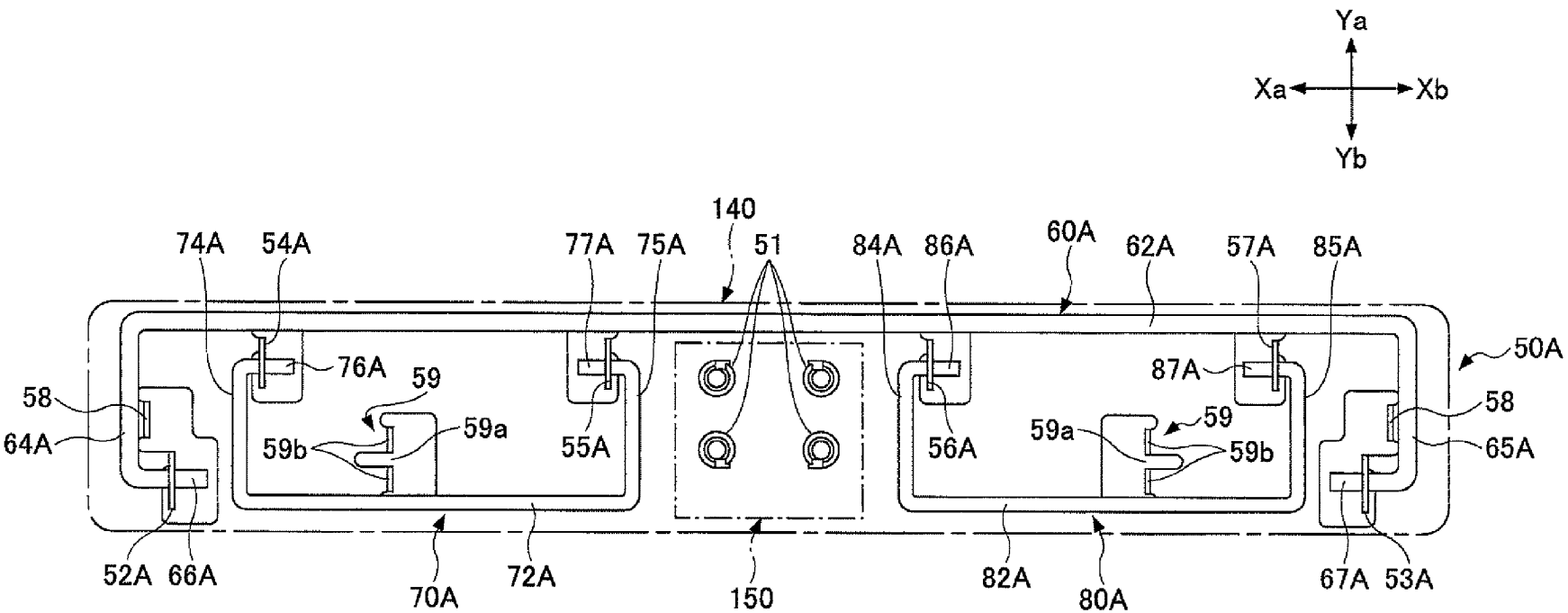
FIG. 14 is a plan view of part of the supporting plate, illustrating an arrangement of first through third wire members, according to the second embodiment of the present invention.

FIG. 14 is a plan view of part of the supporting plate 50A, illustrating an arrangement of the first through third wire members 60A, 70A, and 80A of the second embodiment.

As illustrated in FIG. 14, the first wire member 60A has the end parts 66A and 67A inserted (passed) through the hook holes 52*a* and 53*a* of the supporting parts 52A and 53A, the second wire member 70A has the end parts 76A and 77A inserted (passed) through the hook holes 54*a* and 55*a* of the supporting parts 54A and 55A, and the third wire member 80A has the end parts 86A and 87A inserted (passed) through the hook holes 56*a* and 57*a* of the supporting parts 56A and 57A.

As illustrated in FIG. 12, the hook holes 52*a* through 57*a* are rectangular recesses that extend and are open at the Yb ends in the Ya and the Yb directions. Therefore, the end parts 66A, 67A, 76A, 77A, 86A, and 87A are inserted (passed) through the hook holes 52*a* through 57*a* easily by sliding the end parts 66A, 67A, 76A, 77A, 86A, and 87A from the Yb side to the Ya side.

According to this embodiment, the first wire member 60A larger in overall length has a first beam part 62A provided on the Ya side in the key attachment region 140, and the second wire member 70A and the third wire member 80A that are smaller in overall length have respective second and third beam parts 72A and 82A provided on the Yb side in the key attachment region 140. Further, the second wire member 70A is provided on the left side (Xa side) in the key attachment region 140, and the third wire member 80A is provided on the right side (Xb side) in the key attachment region 140.

The wire members 70A and 80A are provided outside the switch region 150 where the switch mechanism 40 is provided in the key attachment region 140. Accordingly, in the switch region 150, the first beam part 62A of the first wire member 60A is provided on one side (the Ya side), but no wire member is provided on the other side (the Yb side) in the front and the rear direction. As a result, compared with the case of providing a wire member on each side in the front and the rear direction, the key attachment region 140, which corresponds in shape to the outline of the keycap 20A, is reduced in width (the dimension in the front [Ya] and the rear [Yb] direction) by the size of one wire member.

Here, a description is given of a configuration of the keycap 20A on its lower surface side.

Figure 15:
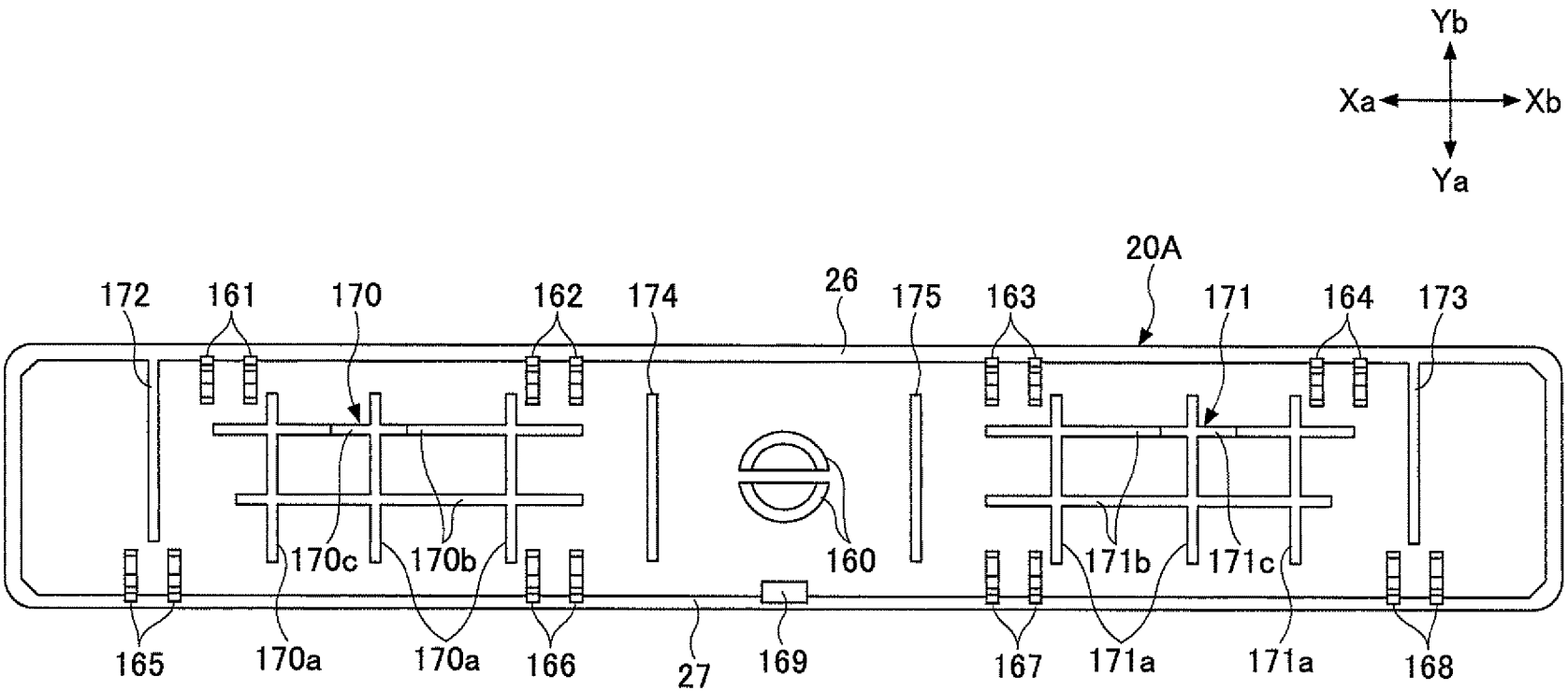
FIG. 15 is a bottom plan view of a keycap according to the second embodiment of the present invention.

FIG. 15 is a bottom plan view of the keycap 20A according to the second embodiment.

As illustrated in FIG. 15, the keycap 20A is molded to have the fitting part 160, the wire engaging parts 161 through 168, the wire contact part 169, the ribs 170 and 171, the partitions 172 and 173, and partitions 174 and 175 as a unitary structure on its lower surface side.

Figure 16:
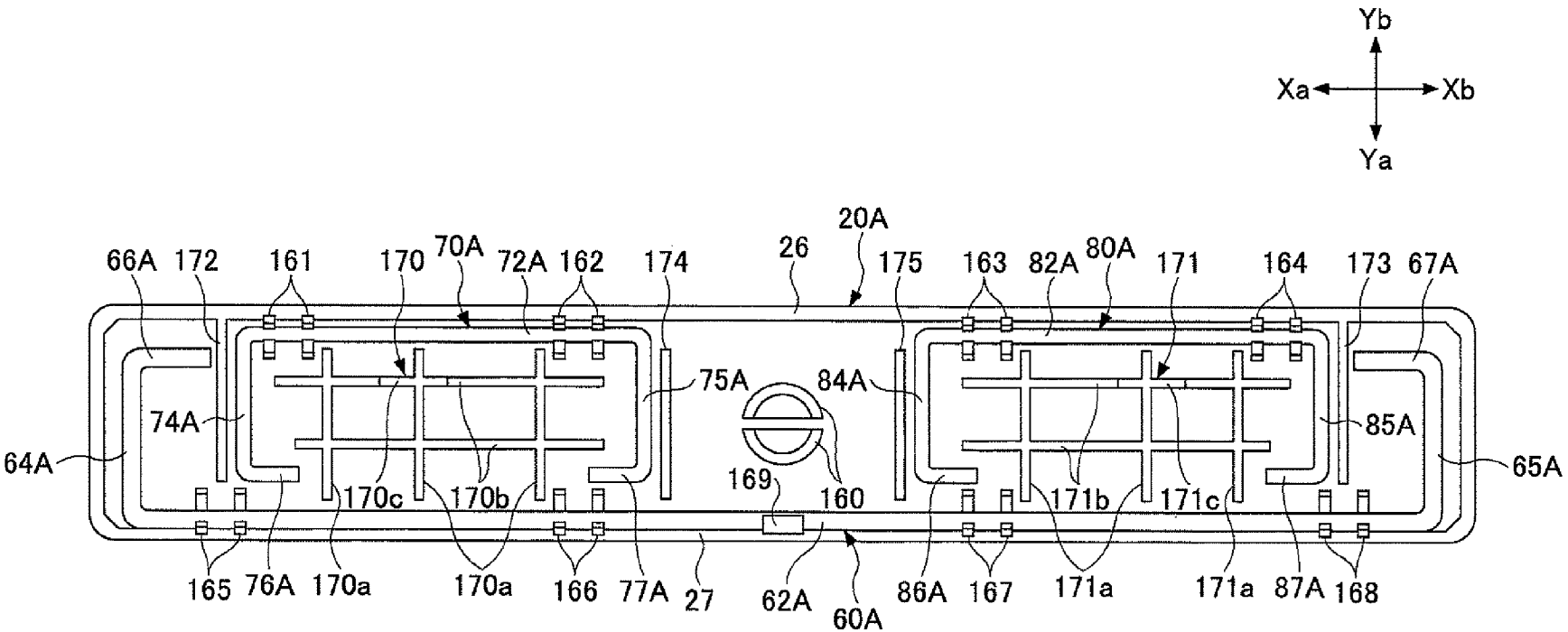
FIG. 16 is a bottom plan view of the keycap to which the first through third wire members are attached on its lower surface side according to the second embodiment of the present invention.

FIG. 16 is a bottom plan view of the keycap 20A of the second embodiment, to which the first through third wire members 60A, 70A, and 80A are attached on its lower surface side.

As illustrated in FIG. 16, the first through third beam parts 62A, 72A, and 82A of the first through third wire members 60A, 70A, and 80A engage the wire engaging parts 161 through 164, the wire engaging parts 165 and 166, and the wire engaging part 167 and 168, respectively, which are formed as a unitary structure on the lower surface side of the keycap 20A. The wire engaging parts 161 through 168 have their respective U-shaped grooves 180 (FIG. 18A, FIG. 18B, FIG. 19A, and FIG. 19B), which are open on the Zb side (in the downward direction).

The wire contact part 169 is in contact with an intermediate portion of the first beam part 62A of the first wire member 60A to prevent the first beam part 62A from bending.

The projecting parts 170*c* and 171*c* of the ribs 170 and 171 are fit into the corresponding slits 59*a* of the key guides 59 (FIG. 13). As a result, the keycap 20A is guided in the directions of its upward movement and downward movement, so that movements other than the upward and the downward movement of the keycap 20A are restricted in order to prevent the keycap 20A from pivoting on the rubber actuator 100.

The Xa-side partition 172 separates the arm part 64A of the first wire member 60A and an arm part 74A of the second wire member 70A from each other to prevent the wire members 60A and 70A from coming into contact (interfering) with each other. Further, the Xb-side partition 173 separates the arm part 65A of the first wire member 60A and an arm part 85A of the third wire member 80A from each other to prevent the wire members 60A and 80A from coming into contact (interfering) with each other.

The partitions 174 and 175 are provided one on each side of the switch region 150 in order to prevent the switch mechanism 40 and the wire members 70A and 80A (for example, arm parts 75A and 84A of the wire members 70A and 80A) from interfering with each other.

The strength of the keycap 20A is increased on each of the Ya side and the Yb side because the first through third beam parts 62A, 72A, and 82A of the first through third wire members 60A, 70A, and 80A, respectively, engage the wire engaging parts 161 through 168 provided on the longer sides of the keycap 20A on its lower surface side.

Therefore, even if the keycap 20A having an elongated shape (in the Xa and the Xb direction) is pressed in a part off its center portion (for example, near the Xa or Xb end), it is possible to prevent the keycap 20A from bending or pivoting on its part contacting the rubber actuator 100.

Further, the Ya-side edge part 27 of the keycap 20A is reinforced over its substantially overall length by the beam part 62A of the wire member 60A, while the Yb-side edge part 26 of the keycap 20A, except for its portion corresponding to the center and its neighborhood of the keycap 20A (the region contacted by the rubber actuator 100) in its lengthwise directions (the Xa and the Xb direction), is reinforced by the beam parts 72A and 82A of the wire members 70A and 80A. Thus, no wire member is provided around the center of the Yb-side edge part 26 in the lengthwise directions. Accordingly, the keycap 20A is reduced in size in the front and the rear direction (the Ya and the Yb direction) by the diameter of a wire member. Thus, the keycap 20A is reduced in size and at the same time is compensated for reduction in strength due to thinning by engaging the beam parts 62A, 72A, and 82A of the wire members 60A, 70A, and 80A with the keycap 20A on its lower surface side.

Here, a description is given of the upward and the downward movement of the key switch unit 10A.

Figure 17A:
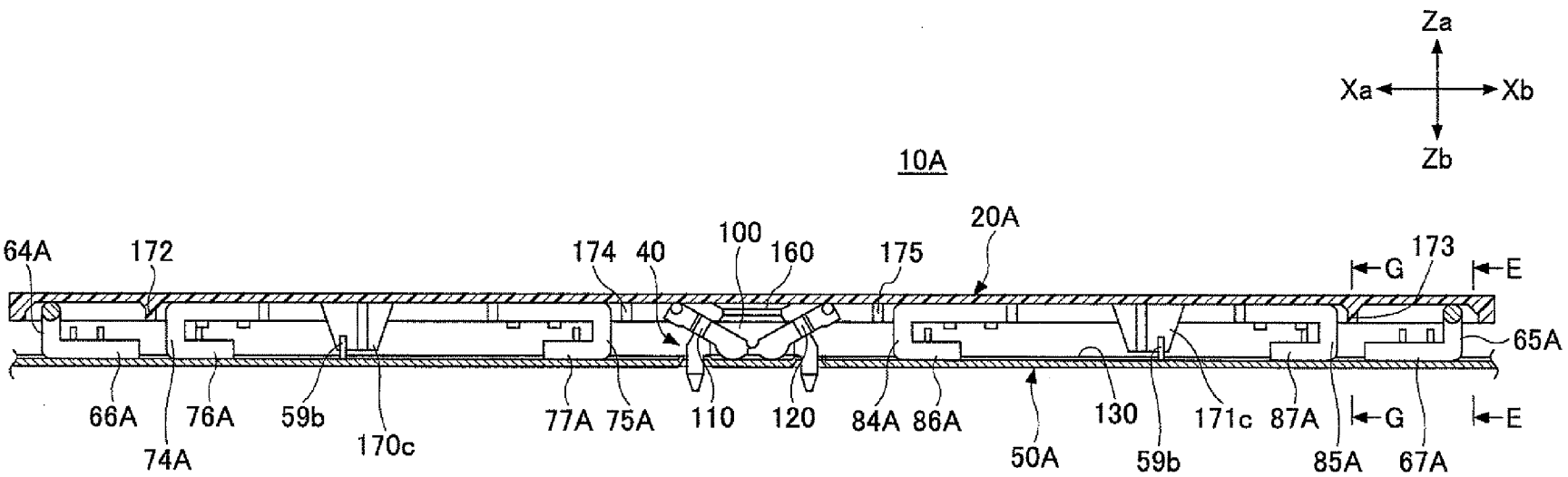
FIG. 17A is a front-side sectional view of the key switch unit in a pre-operation state according to the second embodiment of the present invention.
Figure 17B:
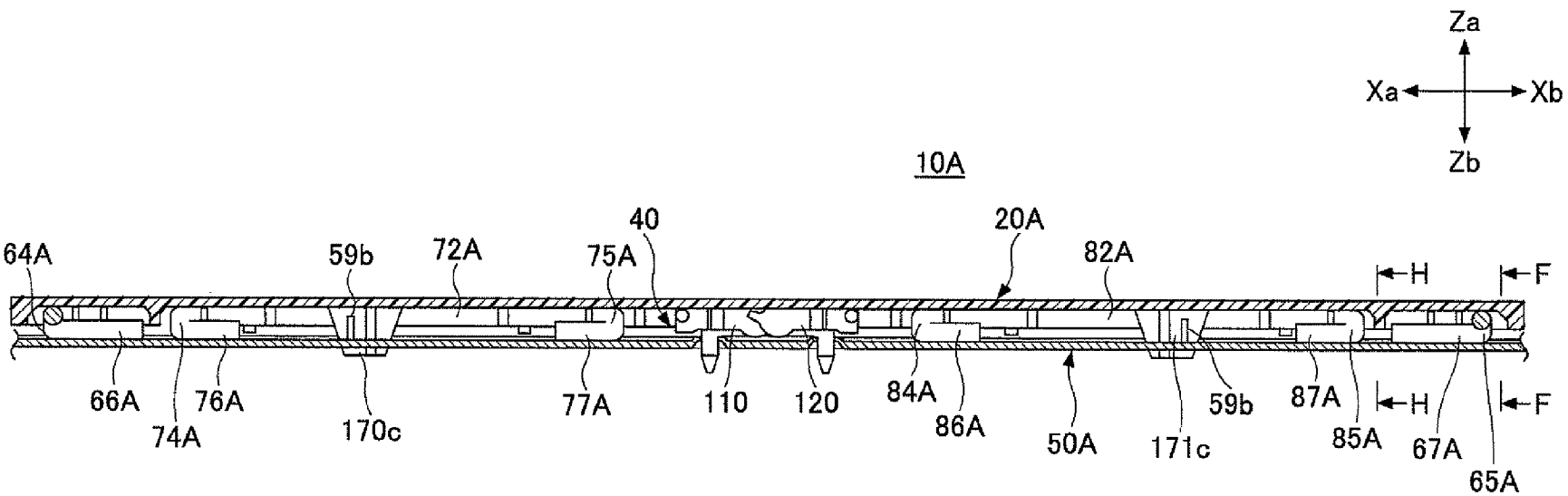
FIG. 17B is a front-side sectional view of the key switch unit in a pressed state according to the second embodiment of the present invention.
Figure 18A:
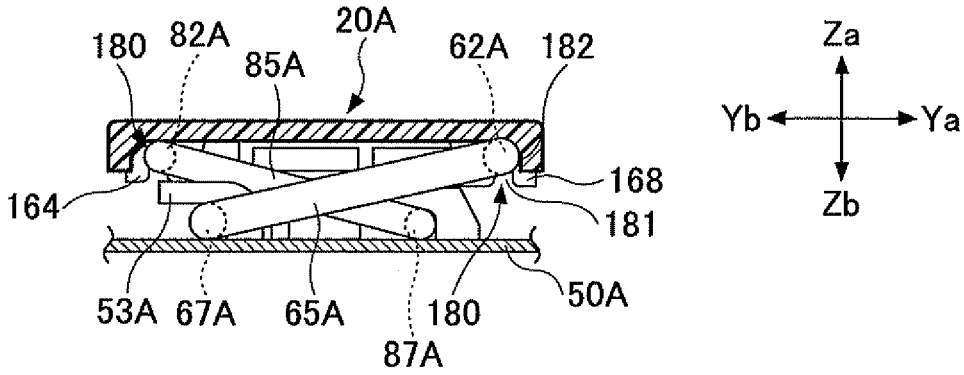
FIG. 18A is a cross-sectional view of the key switch unit taken along line E-E in FIG. 17A according to the second embodiment of the present invention.
Figure 18B:
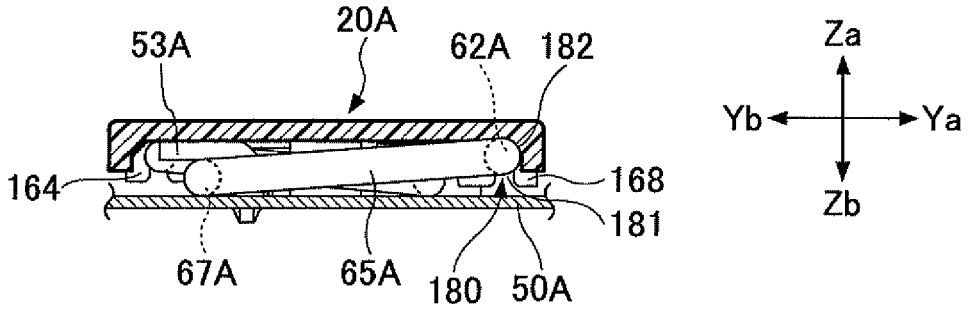
FIG. 18B is a cross-sectional view of the key switch unit taken along line F-F in FIG. 17B according to the second embodiment of the present invention.
Figure 19A:
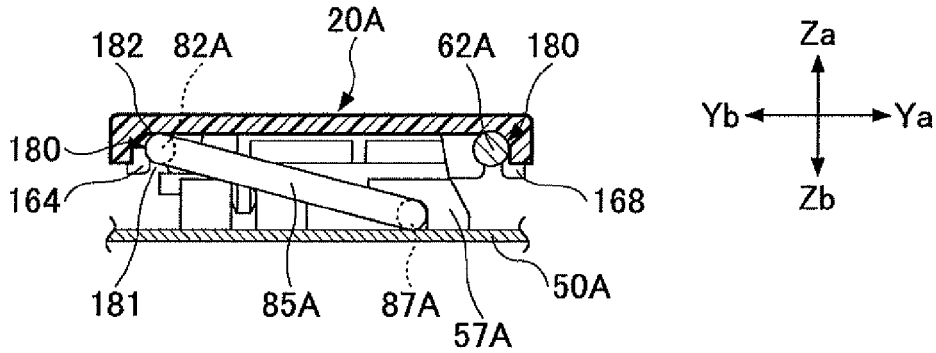
FIG. 19A is a cross-sectional view of the key switch unit taken along line G-G in FIG. 17A according to the second embodiment of the present invention.
Figure 19B:
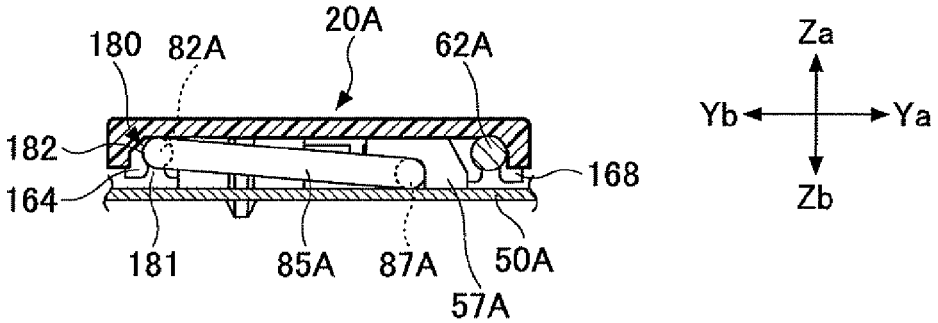
FIG. 19B is a cross-sectional view of the key switch unit taken along line H-H in FIG. 17B according to the second embodiment of the present invention.

FIG. 17A is a front-side sectional view of the key switch unit 10A of the second embodiment in a pre-operation state. FIG. 17B is a front-side sectional view of the key switch unit 10A of the second embodiment in a pressed state. FIG. 18A is a cross-sectional view of the key switch unit 10A taken along line E-E in FIG. 17A. FIG. 18B is a cross-sectional view of the key switch unit 10A taken along line F-F in FIG. 17B. FIG. 19A is a cross-sectional view of the key switch unit 10A taken along line G-G in FIG. 17A. FIG. 19B is a cross-sectional view of the key switch unit 10A taken along line H-H in FIG. 17B.

Referring to FIG. 17A, FIG. 18A, and FIG. 19A as well as FIG. 16, the keycap 20A has its center portion in the lengthwise direction (the Xa and the Xb direction) supported at its upper limit position above the membrane switch sheet 130 by the rubber actuator 100 and the linking members 110 and 120 of the switch mechanism 40, and has the Yb-side edge part 26 and the Ya-side edge part 27 (FIG. 16) supported along the length of the keycap 20A by the wire members 60A, 70A, and 80A.

The first through third beam parts 62A, 72A, and 82A of the first through third wire members 60A, 70A, and 80A engage the U-shaped grooves 180 of the corresponding wire engaging parts 161 through 168, which are formed into a unitary structure on the lower surface side of the keycap 20A. Once the beam parts 62A, 72A, and 82A of the wire members 60A, 70A, and 80A are press-fit into the circular recesses 182 of the corresponding U-shaped grooves 180, the U-shaped grooves 180 hold the beam parts 62A, 72A, and 82A so that the beam parts 62A, 72A, and 82A are prevented from falling off.

Accordingly, at the time of assembly, it is possible to simultaneously engage the beam parts 62A, 72A, and 82A of the wire members 60A, 70A, and 80A with the U-shaped grooves 180 of the corresponding wire engaging parts 161 through 168 by inserting (passing) the end parts 66A, 67A, 76A, 77A, 86A, and 87A of the wire members 60A, 70A, and 80A through the hook holes 52*a* through 57*a* of the supporting parts 52A through 57A as illustrated in FIG. 14 and thereafter moving down the keycap 20A from above. That is, according to this embodiment, like in the first embodiment, an increase in the number of wire members does not increase assembly manhours, thus making it possible to perform assembling with efficiency.

Further, the end parts 66A, 67A, 76A, 77A, 86A, and 87A of the wire members 60A, 70A, and 80A are inserted (passed) through the hook holes 52*a* through 57*a* of the supporting parts 52A through 57A rising up from the supporting plate 50A, and the arm parts 64A, 65A, 74A, 75A, 84A, and 85A of the wire members 60A, 70A, and 80A are inclined in angled positions, extending obliquely upward relative to the supporting plate 50A, and connect the end parts 66A, 67A, 76A, 77A, 86A, and 87A and the beam parts 62A, 72A, and 82A.

Therefore, in conjunction with the upward and the downward movement of the keycap 20A, the wire members 60A, 70A, and 80A turn on the end parts 66A and 67A, the end parts 76A and 77A, and the end parts 86A and 87A, respectively, which serve as rotation shafts. Thus, the keycap 20A has the Yb-side edge part 26 and the Ya-side edge part 27 supported over the overall length in the lengthwise directions by the wire members 60A, 70A and 80A.

As illustrated in FIG. 17B, FIG. 18B, and FIG. 19B, when the upper surface of the keycap 20A is pressed downward, the wire members 60A, 70A, and 80A turn on the end parts 66A and 67A, the end parts 76A and 77A, and the end parts 86A and 87A, respectively, so that the keycap 20A moves down to its lower limit position while keeping its horizontal position. Further, the keycap 20A has the Yb-side edge part 26 and the Ya-side edge part 27 supported by the beam parts 62A, 72A, and 82A of the wire members 60A, 70A, and 80A, and the beam parts 62A, 72A, and 82A are supported through the arm parts 64A and 65A, the arm parts 74A and 75A, and the arm parts 84A and 85, respectively. Therefore, whichever part in the lengthwise directions is pressed, the keycap 20A moves down to its lower limit position while keeping the same horizontal position. This makes it possible to increase the reliability of a switching operation while reducing the keycap 20A in thickness and size.

In the above-described embodiments, the keycaps 20 and 20A, which are elongated laterally (in the Xa and the Xb direction), are taken as examples. However, the present invention is not limited to these, and may be applied to a keycap that is elongated in the front and the rear direction (the Ya and the Yb direction).

Further, in the above-described embodiments, the keycaps 20 and 20A, which are long and narrow, are taken as examples. However, the present invention is not limited to these, and may be applied to a keycap that are elongated in both the lateral directions (the Xa and the Xb direction) and the front and the rear direction (the Ya and the Yb direction), such as a keycap having a square shape or a wide rectangular shape.

Further, in the above-described embodiments, the linking members 110 and 120 are combined into a V-letter shape (relative to the supporting plate 50 or 50A when viewed from the Ya or Yb side). However, the present invention is not limited to this configuration, and the linking members 110 and 120 may be combined into an inverse V-letter shape.

Further, in the above-described embodiments, by way of example, the switch mechanism 40 includes the linking members 110 and 120. However, the present invention may also be applied to a configuration without the linking members 110 and 120.

Further, in the above-described embodiments, a description is given of the case of the keycaps 20 and 20A, each of which is used as one of multiple keys arranged in lines on a keyboard. However, the present invention is not limited to such a case, and may also be applied to the case where the keycap 20 or 20A is used alone.

Further, in the above-described embodiments, the membrane switch sheet 130 closely adheres to the upper surfaces of the supporting plates 50 and 50A. However, the present invention is not limited to such a configuration. For example, a pair of electrode patterns may be formed on the supporting plate 50 or 50A and a conductive member may be provided unitarily on the lower surface of the small-diameter contact part 100*a* (FIG. 2) of the rubber actuator 100 so that the conductive member may come into contact with the electrode patterns to electrically connect the electrode patterns when the small-diameter contact part 100*a* of the rubber actuator 100 is pressed downward.

According to one aspect of the present invention, it is possible to increase the strength of a keycap in its lengthwise directions and also to reduce the size of the keycap in its widthwise directions. Further, even when the keycap is further reduced in thickness, it is possible to increase the operational feeling of pressing the keycap whichever part of the keycap is pressed in its lengthwise direction by allowing the keycap to move down constantly in a horizontal position, and also to increase the reliability of the switching operation of the keycap reduced in thickness and size.

All examples and conditional language recited herein are intended for pedagogical purposes to aid the reader in understanding the present invention and the concepts contributed by the inventors to furthering the art, and are to be construed as being without limitation to such specifically recited examples and conditions, nor does the organization of such examples in the specification relate to a showing of the superiority or inferiority of the present invention. Although the embodiments of the present inventions have been described in detail, it should be understood that various changes, substitutions, and alterations could be made hereto without departing from the spirit and scope of the present invention.

What is claimed is:

1. A key switch unit, comprising:

a keycap elongated in a lengthwise direction;

a switch mechanism configured to operate in response to receiving a pressing force through the keycap;

a supporting plate configured to support the switch mechanism; and a key reinforcement mechanism engaging the keycap on a lower side thereof to reinforce the keycap, the key reinforcement mechanism including a first wire member having a first beam part extending over substantially an overall dimension of the keycap in the lengthwise direction and engaging the keycap on the lower side thereof;

a second wire member having a second beam part extending in the lengthwise direction between a region contacting the switch mechanism and a first lengthwise end of the keycap and engaging the keycap on the lower side thereof; and a third wire member having a third beam part extending in the lengthwise direction between the region contacting the switch mechanism and a second lengthwise end of the keycap and engaging the keycap on the lower side thereof, wherein the first, second, and third wire members have respective end parts turnably supported on the supporting plate.

2. The key switch unit as claimed in claim 1, further comprising:

a first engaging part provided on a first edge part of the keycap along the lengthwise direction on the lower side thereof and engaging the first beam part;

a second engaging part provided on a first portion of a second edge part of the keycap along the lengthwise direction on the lower side thereof and engaging the second beam part; and a third engaging part provided on a second portion of the second edge part of the keycap along the lengthwise direction on the lower side thereof and engaging the third beam part.

3. The key switch unit as claimed in claim 1, wherein:

the first, second, and third wire members include respective first and second arm parts extending at an angle from first and second ends of the first, second, and third beam parts, respectively, the first and second arm parts having end portions thereof bent inward to form the end parts of the first through third wire members; and the supporting plate has a first supporting part, a second supporting part, and a third supporting part provided thereon, the first through third supporting parts being configured to support the end parts of the first through third wire members, respectively, in such a manner as to allow the end parts to turn.

4. The key switch unit as claimed in claim 1, wherein the first, second, and third wire members are arranged in bilateral symmetry with respect to the switch mechanism in the lengthwise direction.

5. A key switch unit, comprising:

a switch;

a keycap for depressing the switch;

a supporting member including a plurality of supporting parts;

a first wire including a first beam rotatably engaged to a lower side of the keycap, and first end portions provided at respective ends of the first wire rotatably engaged to a first one of the supporting parts, the first beam extending between a first lengthwise end and a second lengthwise end of the keycap;

a second wire including a second beam rotatably engaged to the lower side of the keycap, and second end portions provided at respective ends of the second wire rotatably engaged to a second one of the supporting parts, the second beam extending between the switch and the first lengthwise end; and a third wire including a third beam rotatably engaged to the lower side of the keycap, and third end portions provided at respective ends of the third wire rotatably engaged to a third one of the supporting parts, the third beam extending between the switch and the second lengthwise end.

* * * * *